US011526109B2

(12) United States Patent
Kishimoto

(10) Patent No.: US 11,526,109 B2
(45) Date of Patent: Dec. 13, 2022

(54) IMAGE FORMING APPARATUS RESTRICTING USAGE OF NON-SPECIFIC-COLOR CARTRIDGE

(71) Applicant: BROTHER KOGYO KABUSHIKI KAISHA, Nagoya (JP)

(72) Inventor: Noriaki Kishimoto, Aichi-ken (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/372,606

(22) Filed: Jul. 12, 2021

(65) Prior Publication Data

US 2022/0035292 A1 Feb. 3, 2022

(30) Foreign Application Priority Data

Jul. 29, 2020 (JP) ..... JP2020-128287

(51) Int. Cl.
*G03G 15/00* (2006.01)
*G03G 15/01* (2006.01)
(Continued)

(52) U.S. Cl.
CPC ..... *G03G 15/55* (2013.01); *G03G 15/0105* (2013.01); *G03G 15/0863* (2013.01);
(Continued)

(58) Field of Classification Search
CPC .... G03G 15/55; G03G 15/553; G03G 15/556; G03G 15/5016; G03G 15/502;
(Continued)

(56) References Cited

U.S. PATENT DOCUMENTS

2004/0258445 A1 12/2004 Fujimaki et al.
2016/0011554 A1* 1/2016 Shipman ..... G06Q 20/145 399/81
(Continued)

FOREIGN PATENT DOCUMENTS

JP 2004-233850 A 8/2004
JP 2004-354923 A 12/2004
(Continued)

*Primary Examiner* — Carla J Therrien
(74) *Attorney, Agent, or Firm* — Merchant & Gould P.C.

(57) ABSTRACT

In an image forming apparatus, a controller performs processes in accordance with an operation mode settable to one of a first subscription mode and a second subscription mode. The first subscription mode corresponds to a first subscription in which a specific-color cartridge is a subscription subject and a non-specific-color cartridge is not the subscription subject. The second subscription mode corresponds to a second subscription in which both the specific-color cartridge and the non-specific-color cartridge are the subscription subject. The controller performs restricting usage of the non-specific-color cartridge in a case where the first subscription mode is set as the operation mode and the type information of the non-specific-color cartridge indicates the subscription type, compared to a case where the second subscription mode is set as the operation mode and the type information of the non-specific-color cartridge indicates the subscription type.

19 Claims, 21 Drawing Sheets

| SUBSCRIPTION PLAN | TONER CARTRIDGE | | DRUM CARTRIDGE | CORRESPONDING OPERATION MODE |
|---|---|---|---|---|
| | BLACK (K) | COLOR (CMY) | | |
| UNCONTRACTED | × | × | × | NORMAL MODE |
| FIRST SUBSCRIPTION | ○ | × | × | FIRST PRE-SUBSCRIPTION MODE<br>FIRST SUBSCRIPTION MODE |
| SECOND SUBSCRIPTION | ○ | ○ | × | SECOND PRE-SUBSCRIPTION MODE<br>SECOND SUBSCRIPTION MODE |
| THIRD SUBSCRIPTION | ○ | × | ○ | THIRD PRE-SUBSCRIPTION MODE<br>THIRD SUBSCRIPTION MODE |
| FOURTH SUBSCRIPTION | ○ | ○ | ○ | FOURTH PRE-SUBSCRIPTION MODE<br>FOURTH SUBSCRIPTION MODE |

○ : SUBSCRIPTION SUBJECT
× NON-SUBSCRIPTION SUBJECT

(51) Int. Cl.
*G03G 21/18* (2006.01)
*G03G 15/08* (2006.01)

(52) U.S. Cl.
CPC ..... *G03G 15/5016* (2013.01); *G03G 21/1889* (2013.01); *G03G 21/1892* (2013.01)

(58) Field of Classification Search
CPC ..... G03G 15/5075; G03G 15/5091; G03G 15/0863; G03G 21/1889; G03G 21/1892
See application file for complete search history.

(56) References Cited

U.S. PATENT DOCUMENTS

| | | | | |
|---|---|---|---|---|
| 2016/0292550 | A1* | 10/2016 | Kawai | G06K 15/102 |
| 2017/0090830 | A1* | 3/2017 | Tomono | G06F 3/1285 |
| 2018/0131831 | A1 | 5/2018 | Tolia et al. | |
| 2019/0283439 | A1* | 9/2019 | Komine | B41J 2/17503 |
| 2019/0344583 | A1* | 11/2019 | Bartlow | G03G 15/50 |
| 2021/0232877 | A1* | 7/2021 | Shibasaki | G06Q 30/0635 |
| 2021/0237494 | A1* | 8/2021 | Mikami | G06F 3/1285 |
| 2021/0302872 | A1* | 9/2021 | Suzuki | G03G 21/1878 |
| 2021/0303225 | A1* | 9/2021 | Shirai | H04L 41/5025 |
| 2021/0304337 | A1* | 9/2021 | Shishido | G06F 3/1239 |
| 2021/0306479 | A1* | 9/2021 | Kajiyama | H04N 1/0097 |

FOREIGN PATENT DOCUMENTS

| | | | |
|---|---|---|---|
| JP | 2020-506822 | A | 3/2020 |
| WO | 2014/120199 | A1 | 7/2014 |
| WO | 2018/136040 | A1 | 7/2018 |

* cited by examiner

FIG. 4

| SUBSCRIPTION PLAN | TONER CARTRIDGE | | DRUM CARTRIDGE | CORRESPONDING OPERATION MODE |
|---|---|---|---|---|
| | BLACK (K) | COLOR (CMY) | | |
| UNCONTRACTED | × | × | × | NORMAL MODE |
| FIRST SUBSCRIPTION | ○ | × | × | FIRST PRE-SUBSCRIPTION MODE<br>FIRST SUBSCRIPTION MODE |
| SECOND SUBSCRIPTION | ○ | ○ | × | SECOND PRE-SUBSCRIPTION MODE<br>SECOND SUBSCRIPTION MODE |
| THIRD SUBSCRIPTION | ○ | × | ○ | THIRD PRE-SUBSCRIPTION MODE<br>THIRD SUBSCRIPTION MODE |
| FOURTH SUBSCRIPTION | ○ | ○ | ○ | FOURTH PRE-SUBSCRIPTION MODE<br>FOURTH SUBSCRIPTION MODE |

○ : SUBSCRIPTION SUBJECT
× NON-SUBSCRIPTION SUBJECT

FIG. 5

731

| USER INFORMATION | DEVICE INFORMATION | PAYMENT INFORMATION | ADDRESS INFORMATION | SUBSCRIPTION PLAN INFORMATION | OPERATION MODE INFORMATION | CUMULATED NUMBER OF PRINTED PAGES SUBJECT TO CHARGES |
|---|---|---|---|---|---|---|
| ○×△ | 123456 | (CREDIT CARD, BANK ACCOUNT, OR ETC) | xxx-xxxx ··· | FIRST SUBSCRIPTION | FIRST PRE-SUBSCRIPTION MODE | 1056 |
| ○△× | 213456 | (CREDIT CARD, BANK ACCOUNT, OR ETC) | xxx-xxxx ··· | SECOND SUBSCRIPTION | SECOND PRE-SUBSCRIPTION MODE | 1130 |
| ×○△ | 151356 | (CREDIT CARD, BANK ACCOUNT, OR ETC) | xxx-xxxx ··· | THIRD SUBSCRIPTION | THIRD SUBSCRIPTION MODE | 2039 |
| ×△○ | 237192 | (CREDIT CARD, BANK ACCOUNT, OR ETC) | xxx-xxxx ··· | FOURTH SUBSCRIPTION | FOURTH SUBSCRIPTION MODE | 12954 |
| △○× | 351356 | (CREDIT CARD, BANK ACCOUNT, OR ETC) | xxx-xxxx ··· | FIRST SUBSCRIPTION | FIRST SUBSCRIPTION MODE | 1239 |
| △×○ | 353221 | (CREDIT CARD, BANK ACCOUNT, OR ETC) | xxx-xxxx ··· | SECOND SUBSCRIPTION | SECOND PRE-SUBSCRIPTION MODE | 153 |
| | | | | | | |

IMAGE FORMING APPARATUS RESTRICTING USAGE OF NON-SPECIFIC-COLOR CARTRIDGE

CROSS REFERENCE TO RELATED APPLICATION

This application claims priority from Japanese Patent Application No. 2020-128287 filed Jul. 29, 2020. The entire content of the priority application is incorporated herein by reference.

TECHNICAL FIELD

The present disclosure relates to an image forming apparatus and a method of controlling the image forming apparatus.

BACKGROUND

In recent years, cartridges for use with image forming apparatuses are provided to users through a subscription service. For example, prior art describes a service that uses a server to manage cartridge usage for subscription in an image forming apparatus. Specifically, the server issues credit the image forming apparatus based on a user's payment. Upon receiving a print job, the image forming apparatus checks the remaining credit therefor to determine whether printing operation using subscription cartridges can be performed. When determining that printing operation is not allowed based on an amount of the remaining credit, the image forming apparatus requests the user to replace the subscription cartridge with a commercial cartridge or to add credit.

SUMMARY

An image forming apparatus with the capacity for color printing uses black printing material, and printing material in colors different from black (yellow, cyan, magenta, etc.). The prior art technology described above cannot implement a subscription model that provides the user with only a cartridge containing black printing material under subscription and does not provides the user with the remaining cartridges (at least one of the colors yellow, cyan, and magenta) under subscription. Therefore, the prior art technology cannot meet the demands of users who wish to use only cartridges accommodating black printing material under subscription.

In view of the foregoing, it is an object of the present disclosure to provide a technology for an image forming apparatus capable of offering only cartridges that accommodate specific color printing material under subscription.

In order to attain the above and other objects, the disclosure provides an image forming apparatus. The image forming apparatus includes a main casing, a plurality of cartridges, a printing mechanism, and a controller. The plurality of cartridges is capable of being attached to the main casing. The plurality of cartridges includes a specific-color cartridge and a non-specific-color cartridge. The specific-color cartridge includes a specific-color casing and a specific-color memory. The specific-color casing is configured to accommodate printing material of a specific color. The specific-color memory is configured to store type information indicating one of a normal type and a subscription type. The non-specific-color cartridge includes a non-specific-color casing and a non-specific-color memory. The non-specific-color casing is configured to accommodate printing material of a non-specific color other than the specific color. The non-specific-color memory is configured to store type information indicating one of a normal type and a subscription type. The printing mechanism is configured to execute a print process using the plurality of cartridges. The controller is configured to perform processes in accordance with an operation mode for the image forming apparatus, the operation mode being settable to one of a first subscription mode and a second subscription mode. The first subscription mode corresponds to a first subscription in which the specific-color cartridge is a subscription subject and the non-specific-color cartridge is not the subscription subject. The second subscription mode corresponds to a second subscription in which both the specific-color cartridge and the non-specific-color cartridge are the subscription subject. The controller is configured to perform restricting usage of the non-specific-color cartridge in a case where the first subscription mode is set as the operation mode and the type information of the non-specific-color cartridge indicates the subscription type, compared to a case where the second subscription mode is set as the operation mode and the type information of the non-specific-color cartridge indicates the subscription type.

According to another aspect, the disclosure provides a method for an image forming apparatus. The method includes: a print process to execute printing using a plurality of cartridges capable of being attached to the image forming apparatus, the plurality of cartridges including a specific-color cartridge and a non-specific-color cartridge, the specific-color cartridge being configured to accommodate printing material of a specific color, the non-specific-color cartridge being configured to accommodate printing material of a non-specific color other than the specific color; an identification process to identify whether a type of the non-specific-cartridge is a normal type or a subscription type; a shifting process to shift an operation mode to one of a first subscription mode and a second subscription mode, the first subscription mode corresponding to a first subscription in which the specific-color cartridge is a subscription subject and the non-specific-color cartridge is not the subscription subject, the second subscription mode corresponding to a second subscription in which both the specific-color cartridge and the non-specific-color cartridge are the subscription subject; and a restricting process to restrict usage of the non-specific-color cartridge in a case where the first subscription mode is set as the operation mode and the type of the non-specific-color cartridge is the subscription type, compared to a case where the second subscription mode is set as the operation mode and the type of the non-specific-color cartridge is the subscription type.

BRIEF DESCRIPTION OF THE DRAWINGS

The particular features and advantages of the disclosure as well as other objects will become apparent from the following description taken in connection with the accompanying drawings, in which:

FIG. 4 is a table illustrating types of subscription plans which a user can join;

FIG. 5 is a table illustrating an example of management information;

DETAILED DESCRIPTION

Figure 1:
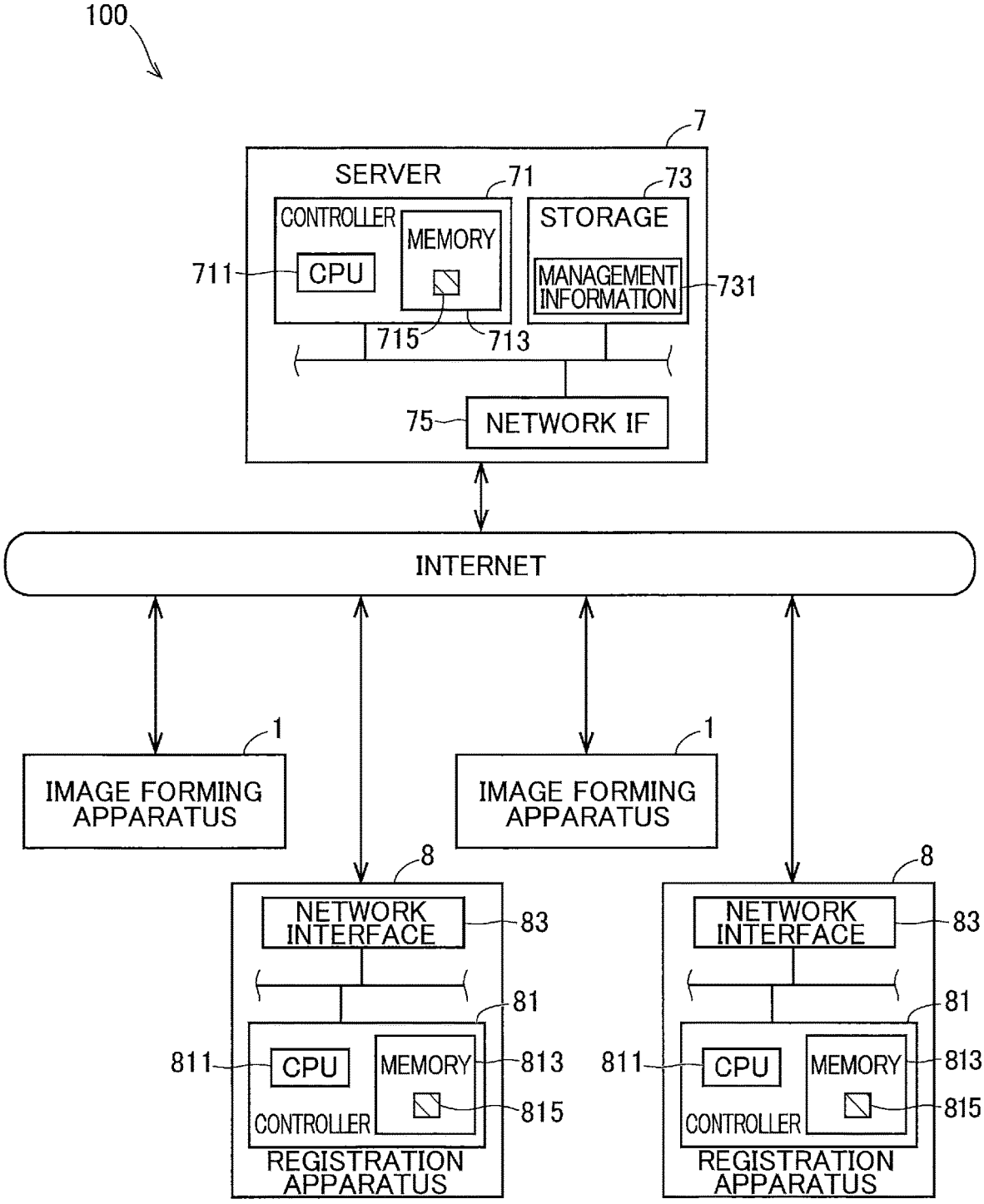
FIG. 1 is a block diagram illustrating an image formation system according to an embodiment.

An embodiment of the present disclosure will be described while referring to accompanied drawings. Configurations described in the embodiment is an example, and the scope of the present disclosure is not limited thereto. In the drawings, a dimension or number of each part may be simplified in order to facilitate understanding as necessary.

1. Embodiment

FIG. 1 shows an image formation system 100 according to the embodiment. The image formation system 100 includes at least one image forming apparatus 1, a contract management server 7, and at least one registration apparatus 8. The image forming apparatuses 1 and the registration apparatuses 8 are connected to the contract management server 7 over an internet and are capable of communicating with the contract management server 7.

<Configuration of Image Forming Apparatuses>

Figure 2:
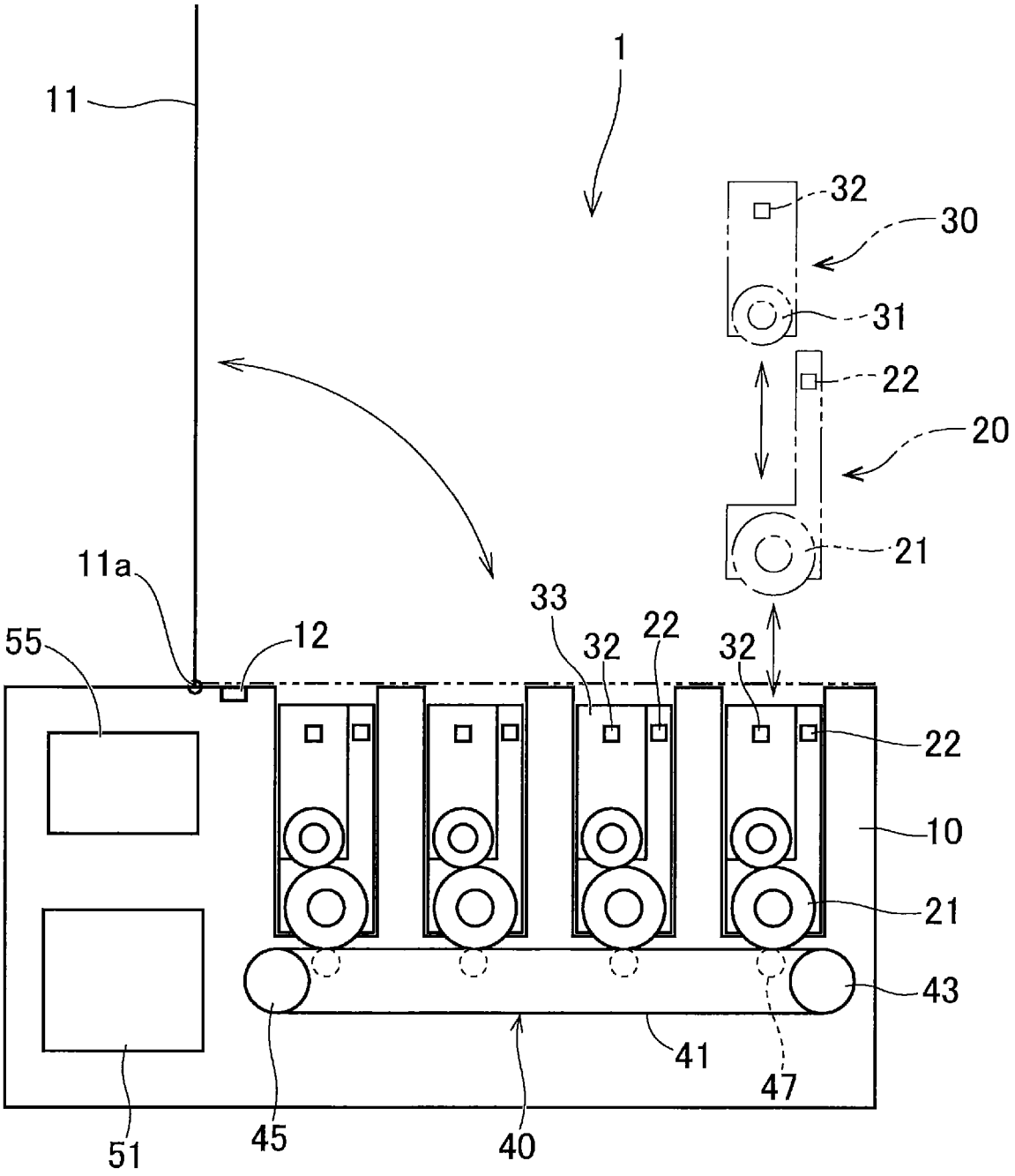
FIG. 2 is a schematic diagram illustrating a configuration of the image forming apparatus according to the embodiment.
Figure 3:
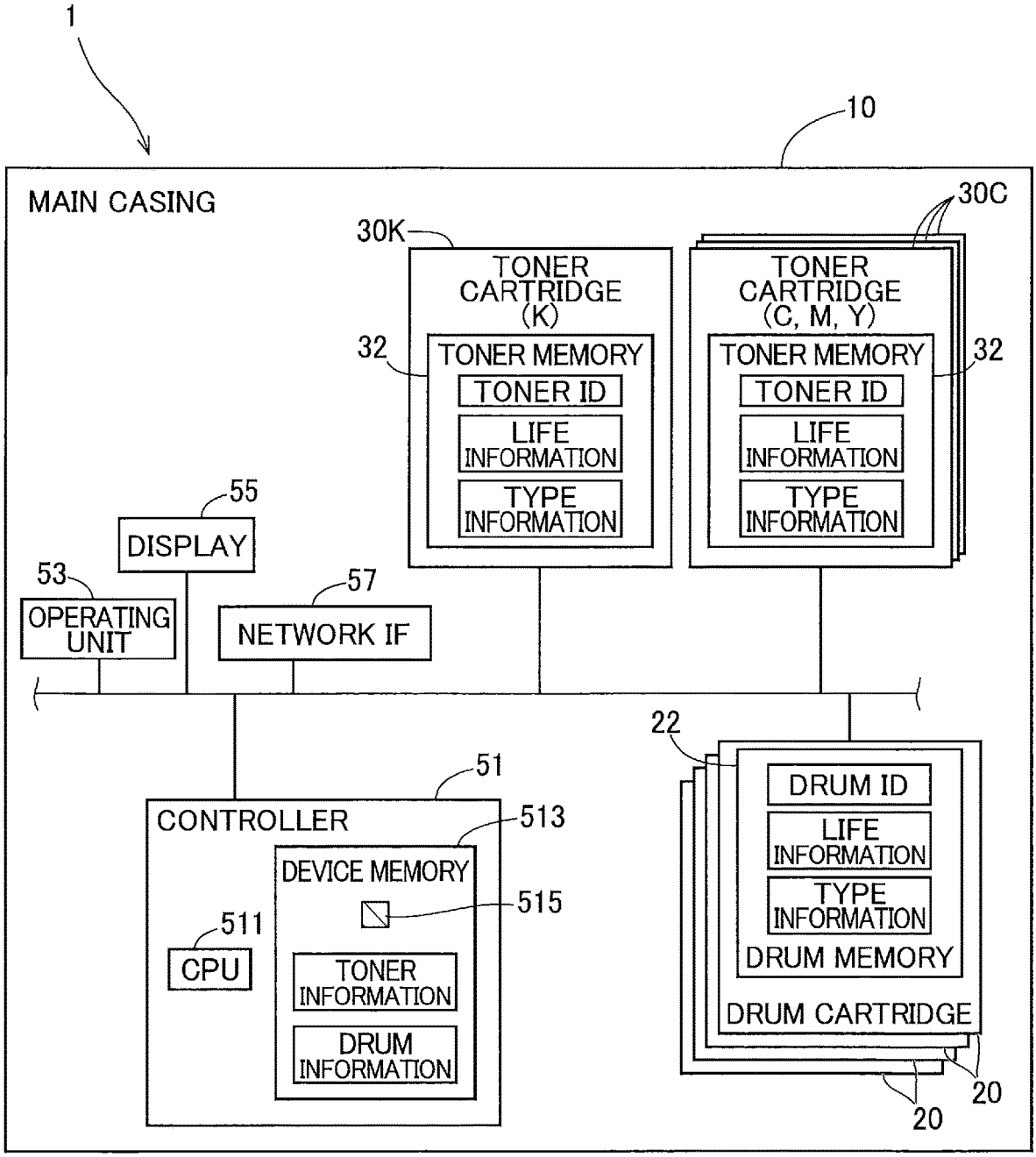
FIG. 3 is a block diagram illustrating electrical connection between a controller and other components in the image forming apparatus.

FIG. 2 is a schematic diagram illustrating a configuration of the image forming apparatus 1 according to the embodiment. FIG. 3 is a diagram illustrating electrical connection between a controller 51 and other components in the image forming apparatus 1. FIG. 2 illustrates the image forming apparatus 1 that includes a main casing 10, a cover 11, four drum cartridges 20, four toner cartridges 30, four light source units (not illustrated), a transfer unit 40, the controller 51, and a display 55.

The main casing 10 has a rectangular box shape. The four drum cartridges 20, the four toner cartridges 30, the transfer unit 40, and the controller 51 are accommodated in the main casing 10. The four drum cartridges 20 and the four toner cartridges 30 can be attached to and detached from the main casing 10. The display 55 is positioned at an outer surface of the main casing 10. The main casing 10 includes a frame for retaining the four drum cartridge 20.

The cover 11 is pivotally movable about a rotational shaft 11*a* extending in a first direction. Specifically, the cover 11 is pivotally movable between an open position (a position indicated by solid lines in FIG. 2) and a closed position (a position indicated by two-dot chain lines). Note that the first direction is a direction in which a rotation axis (a drum axis) of a photosensitive drum 21 (described later) extends. A sensor 12 is electrically connected to the controller 51 and positioned at the main casing 10. The sensor 12 is configured to transmit to the controller 51 a signal indicating that movement of the cover 11 between the open position and the closed position is detected.

Each drum cartridge 20 includes one photosensitive drum 21. The photosensitive drum 21 is a hollow cylindrical member extending in the first direction, and rotatable about a drum axis extending in the first direction. As illustrated in FIG. 2, each drum cartridge 20 further includes a drum memory 22. The drum memory 22 is flash ROM or EEPROM, for example. The drum memory 22 stores therein information related to the drum cartridge 20 to which the drum memory 22 is attached.

Each drum cartridge 20 also includes a frame to which one toner cartridge 30 is attachable and from which the toner cartridge 30 is detachable. The drum cartridge 20 to which the toner cartridge 30 is attached is attached to the main casing 10.

Each toner cartridge 30 includes a developing roller 31, a toner memory 32, and a casing 33. The developing roller 31 is a cylindrically shaped member that extends in the first direction. The developing roller 31 is rotatable about a developing shaft extending in the first direction. The toner memory 32 is a storage medium to which information is writable and from which information is readable, such as a flash ROM or an EEPROM. The toner memory 32 stores therein information related to the toner cartridge 30 to which the toner memory 32 is attached. The casings 33 of the four toner cartridges 30 accommodate therein toner of colors different from one another (cyan, magenta, yellow, and black, for example).

The casing 33 that accommodates black toner (printing material) corresponds to a black casing. Hereinafter, a toner cartridge 30 that includes a casing for black will be called a black cartridge 30K. The toner memory 32 of the black cartridge 30K is an example of a specific-color (black) toner memory. Further, cyan, magenta, and yellow are examples of colors other than the specific color (black). The casings 33 that accommodate toner in cyan, magenta, and yellow are examples of non-specific color casings (color casings). Hereinafter, the toner cartridges 30 including non-specific-color casings (color casings) will be called color cartridges 30C. The toner memories 32 of the color cartridges 30C are examples of non-specific-color memories (color toner memories).

In a state where the cover 11 is in the open position, the drum cartridge 20 to which the toner cartridge 30 is attached is attached to the main casing 10, as illustrated in FIG. 2.

Specifically, the drum cartridge 20 to which the toner cartridge 30 is attached is inserted through an opening in the main casing 10 and attached to a cartridge retaining portion of the main casing 10.

The four light source units are attached to an inner surface of the main casing 10. When the drum cartridge 20 to which the toner cartridge 30 is attached is attached to the main casing 10 and the cover 11 moves to the closed position, each light source unit faces the surface of the corresponding photosensitive drum 21. Each light source unit can irradiate an outer circumferential surface of the corresponding photosensitive drum 21 with light. Light sources in the light source units may be lasers or light-emitting diodes (LEDs).

The transfer unit 40 includes the transfer belt 41, a driving roller 43, a driven roller 45, and four transfer rollers 47. The transfer belt 41 is an endless belt that has an annular shape. Each photosensitive drum 21 has an outer circumferential surface that can contact an outer peripheral surface of the transfer belt 41. The transfer belt 41 is looped over the driving roller 43 and the driven roller 45. The controller 51 controls the driving roller 43 to be driven to circularly move the transfer belt 41. The driven roller 45 rotates in accordance with the transfer belt 41 that moves by driving of the driving roller 43.

The four transfer rollers 47 are positioned in a space formed inside the annular transfer belt 41. Each transfer roller 47 is a cylindrical shaped member and extends in the first direction. Each transfer roller 47 is rotatable about a rotational axis extending in the first direction. An outer circumferential surface of each transfer roller 47 is configured of a conductive rubber, for example. A transfer bias is applied to each transfer roller 47.

The transfer rollers 47 are positioned below the corresponding photosensitive drums 21. The transfer belt 41 is positioned between the photosensitive drums 21 and the transfer rollers 47. When transfer bias is applied to the outer circumferential surfaces of the transfer rollers 47, toners carried on the outer circumferential surfaces of the corresponding photosensitive drums 21 are transferred onto the transfer belt 41, and then the toners transferred onto the transfer belt 41 are further transferred onto a printing paper by transfer mechanism (not illustrated), whereby an image is formed onto the printing paper.

When a printing process is performed in the image forming apparatus 1, the entire outer circumferential surface of the photosensitive drum 21 in the drum cartridge 20 is uniformly charged. The corresponding light source unit irradiates the outer circumferential surface of the photosensitive drum 21 with laser light or LED light based on an image to be printed.

Next, each developing roller 31 deposits toner onto the outer circumferential surface of the corresponding photosensitive drum 21 that was exposed to light. The transfer unit 40 transfers toner carried on each photosensitive drum 21 onto the printing paper. After toner is transferred onto the printing paper, the printing paper passes through a fixing unit (not illustrated), whereby the toner is thermally fixed to the printing paper. The drum cartridge 20 and the transfer unit 40 is an example of a printing mechanism that performs a printing process using the toner cartridges 30.

As illustrated in FIG. 3, the image forming apparatus 1 also includes the controller 51, an operating unit 53, the display 55, and a network interface 57. The controller 51 includes a CPU 511, and a device memory 513. The device memory is a storage medium, such as a flash ROM or EEPROM, from which information can be read and to which information can be written. The device memory 513 stores therein a program 515. The controller 51 is configured to execute various processes by operating the CPU 511 in accordance with the program 515. Note that the controller 51 may include a dedicated circuit such as an ASIC (application specific integrated circuit).

The operating unit 53 is buttons that receives user's operations. The display 55 displays thereon various information. Note that the display 55 may also be configured as a touchscreen that functions as the operating unit 53. The network interface 57 is an example of a communication interface causing the image forming apparatus 1 to communicate with the contract management server 7.

When the four drum cartridges 20 and the four toner cartridges 30 are attached to the main casing 10 as illustrated in FIG. 2, the four drum memories 22 and the four toner memories 32 are electrically connected to the controller 51, as illustrated in FIG. 3. Accordingly, the controller 51 can communicate with the drum memories 22 and the toner memories 32.

Each drum memory 22 stores therein a drum ID, drum life information, drum type information, and drum history information. The drum ID is identification information for identifying an individual drum cartridge 20, and specifically, is a serial number. The drum life information includes the accumulated number of rotations of the photosensitive drum 21, and the accumulated number of pages printed using the photosensitive drum 21, for example.

The accumulated number of rotations of the photosensitive drum 21 is calculated by incrementing or decrementing the number of rotations for the drum cartridge 20 identified by the drum ID each time the drum cartridge 20 is used for a print job. The accumulated number of pages is calculated by incrementing or decrementing the number of printed pages for the drum cartridge 20 identified by the drum ID each time the drum cartridge 20 is used for a print job.

The drum type information is information representing the type of the drum cartridge 20, and specifically is one of: a subscription type and a normal type. The drum type information is used for controlling usage of the drum cartridge 20 on the image forming apparatus 1. Hereinafter, a drum cartridge 20 having the drum type information "subscription type" will simply be called a "subscription-type drum cartridge 20" and a drum cartridge 20 having the drum type information "normal type type" will simply be called a "normal-type drum cartridge 20."

As illustrated in FIG. 3, the toner memory 32 stores therein a toner ID, toner life information, and toner type information. The toner ID is identification information for identifying an individual toner cartridge 30, and specifically, a serial number. The toner life information is information indicating a remaining life of the toner cartridge 30, and is at least one of an accumulated number of rotations of the developing roller 31, an accumulated number of pages printed using the developing roller 31, and an accumulated number of dots.

The accumulated number of rotations of the developing roller 31 is calculated by incrementing or decrementing the number of rotations for the toner cartridge 30 identified by the toner ID each time a print job is performed using the toner cartridge 30. The accumulated number of pages is calculated by incrementing or decrementing the number of printed pages for the toner cartridge 30 identified by the toner ID each time a print job is performed with the toner cartridge 30.

The accumulated number of dots formed using the developing roller 31 is calculated by incrementing or decrementing the number of dots for the toner cartridge 30 identified by the toner ID each time a print job is performed using the toner cartridge 30. Note that the accumulated number of dots corresponds to a usage amount of the toner used in a print job. Accordingly, a remaining amount of toner in the toner cartridge 30 can be calculated by using a total amount of toner that was accommodated in the casing 33 when the toner cartridge 30 was a new product and the accumulated number of dots.

The toner memory 32 may also store color information. The color information specifies the color (black, yellow, or etc.) of toner stored in the casing 33 of the corresponding toner cartridge 30. By acquiring the color information stored in each toner memory 32, the controller 51 can differentiate the plurality of toner cartridges 30 attached to the main casing 10.

The toner type information indicates a type of the toner cartridge 30, and specifically is one of: a subscription type and a normal type. The toner type information is used for controlling usage of the toner cartridge 30 in the image forming apparatus 1. Hereinafter, a toner cartridge 30 whose type indicated by the toner type information is "subscription type" will be simply referred to as a "subscription-type toner cartridge 30", and a toner cartridge 30 whose type indicated by the toner type information is "normal type" will be simply referred to as a "normal-type toner cartridge 30".

The drum memory 22 may also store compatible models of image forming apparatuses 1 for the drum cartridge 20, specifications of the drum cartridge 20, information indicating that the drum cartridge 20 is a new product or indicating that the drum cartridge 20 is not a new product, information indicating that the drum cartridge 20 is a genuine product or indicating that the drum cartridge 20 is not a genuine product, error history of the drum cartridge 20, and the like. The toner memory 32 may also store compatible models of image forming apparatuses 1 for the toner cartridge 30, specifications of the toner cartridge 30, information indicating that the toner cartridge 30 is a new product or indicating that the toner cartridge 30 is not a new product, information indicating that the toner cartridge 30 is a genuine product or indicating that the toner cartridge 30 is not a genuine product, and the like.

The controller 51 stores in the device memory 513 various information read from each drum memory 22 as drum information. The controller 51 also stores in the device memory 513 various information read from each toner memory 32 as toner information. The drum information includes drum life information indicating the remaining life of the drum cartridge 20. The toner information includes toner life information indicating the remaining life of the black cartridge 30K, and toner life information indicating the remaining life of each color cartridge 30C. The device memory 513 that stores the drum information and the toner information corresponds to the life memory.

The controller 51 may update the drum information and toner information stored in the device memory 513 as needed. For example, in a case where printing is performed using drum cartridges 20 and the toner cartridges 30, the controller 51 may update the drum life information in the drum information and the toner life information in the toner information based on the usage of each cartridge. The controller 51 may also update the various information stored in the corresponding drum memories 22 and toner memories 32 based on the updated drum information or toner information.

In the following description, the black cartridge 30K, the color cartridges 30C, and the drum cartridges 20 may simply be referred to as "cartridges" in a case where no distinction is being made. Further, subscription-type toner cartridges 30 and subscription-type drum cartridges 20 may simply be referred to as "subscription-type cartridges" in a case where no distinction is being made, and normal-type toner cartridges 30 and normal-type drum cartridges 20 may simply be referred to as "normal-type cartridges" when no distinction is being made. Additionally, drum life information and toner life information may simply be referred to as "life information" in a case where no distinction is being made.

A subscription-type cartridge is provided by a supplier or the like to a user that joined a specific subscription plan. Further, a normal-type cartridge is an ordinary, commercially available cartridge that a user can obtain without joining a subscription plan.

<Subscription Plans>

FIG. 4 shows various types of subscription plans which the user may join. The cartridge supplier has prepared a plurality of subscription plans that the user of the image forming apparatus 1 can join. When the user joins a subscription plan, the user and supplier enter an agreement. As shown in FIG. 4, the subscription plan is set to one of a first subscription, a second subscription, a third subscription, and a fourth subscription. However, other subscription plans may be provided in addition to the first through fourth subscriptions.

A billing system and a billing amount are set appropriately for each subscription plan. For example, a flat-rate system, a measured-rate system, a hybrid flat-rate/measured-rate system, or the like may be adopted as the billing system. In a flat-rate system, the user pays a fixed rate for a prescribed time period (one month, for example), regardless of cartridge usage. In a measured-rate system, charges are determined based on cartridge usage. In the hybrid system, the user pays a flat rate up to a preset printing quantity but, when exceeding the preset printing quantity, pays a surcharge that corresponds to the excess quantity. Further, charges may be established based on the number of pages printed; the cartridge usage; whether the printing mode is monochrome, color, or the like; the printing resolution; or the size of the printing paper.

Further, the one or more types of cartridges are previously registered or classified as subscription subjects for each subscription plan, as shown in FIG. 4. Specifically, the first subscription preregisters only the black cartridges 30K as the subscription subjects and not color cartridges 30C. The second subscription preregisters both the black cartridges 30K and the color cartridges 30C as the subscription subjects. Neither the first subscription nor the second subscription preregisters the drum cartridges 20 as the subscription subjects.

The third subscription preregisters the black cartridges 30K as the subscription subjects but not color cartridges 30C as the subscription subjects. The fourth subscription preregisters both the black cartridges 30K and the color cartridges 30C as the subscription subjects. Both the third subscription and fourth subscription also preregister the drum cartridges 20 as the subscription subjects.

The controller 51 of the image forming apparatus 1 can shift to specific one of operation modes. The operation modes include a normal mode, pre-subscription modes, and subscription modes. The pre-subscription modes include a first pre-subscription mode, a second pre-subscription mode, a third pre-subscription mode, and a fourth pre-subscription mode. The subscription modes include a first subscription mode, a second subscription mode, a third subscription mode, and a fourth subscription mode.

The normal mode is the operation mode used when the user is uncontracted, i.e., when the user does not join any subscription plan. The first subscription mode, the second subscription mode, the third subscription mode, and the fourth subscription mode are the operation modes used respectively under the first subscription, the second subscription, the third subscription, and the fourth subscription. The first pre-subscription mode, the second pre-subscription mode, the third pre-subscription mode, and the fourth pre-subscription mode are the operation modes from which the controller 51 respectively enters the first subscription mode, the second subscription mode, the third subscription mode, and the fourth subscription mode.

The controller 51 can execute a process depending on each operation mode. The processing content depending on each operation mode is regulated by the program 515. For example, the controller 51 shifts from the normal mode to a pre-subscription mode based on contract information 403 transmitted from the contract management server 7. In the pre-subscription mode, the controller 51 executes a process to enter the corresponding subscription mode. In the pre-subscription mode or the subscription mode, the controller 51 executes a process to transmit the numbers of printed pages printed on the image forming apparatus 1 to the contract management server 7, and the contract management server 7 manages the numbers of printed pages on the image forming apparatus 1 in this way.

In each operation mode, in a case where a cartridge which is not registered or classified as the subscription subject is a subscription type, the controller 51 restricts the use of the cartridge of the non-subscription subject compared to a case where a cartridge which is not registered or classified as the subscription subject is a normal-type. For example, the first subscription does not preregister the color cartridges 30C as the subscription subjects. Therefore, in the first pre-subscription mode or the first subscription mode, in a case where the color cartridge 30C is the subscription type, the controller 51 restricts the use of the color cartridge 30C, compared to a case where the color cartridge 30C is the normal type.

Here, "to restrict the use of a cartridge" includes such actions as preventing the use of the cartridge, displaying information on the display 55 indicating that the cartridge is not registered as the subscription subject, or modifying printing conditions for using the cartridge. Moreover, modifying printing conditions may involve forcibly modifying the toner density used during printing, for example.

<Contract Management Server 7>

The contract management server 7 is a device that manages information related to users joining subscription plans, payments, and provision of services to users joining subscription plans. Services provided to users include a service for shipping subscription-type cartridges to users, for example. The contract management server 7 has a controller 71, a storage 73, and a network interface 75. The controller 71 is electrically connected to the storage 73 and the network interface 75 by bus lines.

The controller 71 has a CPU 711, and a memory 713. The memory 713 is a storage medium that allows reading and writing of information, such as flash ROM or EEPROM. The memory 713 stores a program 715. The controller 71 executes various processes with the CPU 711 performing operations according to the program 715. The storage 73 is a hard disk drive or other storage. The storage 73 stores management information 731.

FIG. 5 shows an example of the management information 731. In the example of FIG. 5, the management information 731 includes user information, device information, payment information, address information, subscription plan information, operation mode information, and the cumulated number of printed pages subject to charges. The user information is for identifying the user. The device information identifies the image forming apparatus 1 used by the user. The payment information is used for paying charges, and specifically is information for a credit card or a bank account. The address information specifies the destination to which the shipping company is to ship the cartridges. The subscription plan information represents the subscription plan (one of the first through fourth subscriptions) which the user joins. The operation mode information indicates the operation mode of the image forming apparatus 1. The cumulated number of printed pages subject to charges is a value that the contract management server 7 obtains by accumulating the numbers of printed pages transmitted from the image forming apparatus 1. Alternatively, the cumulated number of printed pages may be a value accumulated by the image forming apparatus 1 itself.

<Registration Apparatuses 8>

The registration apparatuses 8 are information terminals used for registering various information. Specifically, each registration apparatus 8 may be a portable terminal such as a smartphone or a tablet computer owned by a user wishing to join a subscription plan, a computer connected to the image forming apparatus 1 via a cable, or an information terminal operated by the supplier or the like.

As shown in FIG. 1, each registration apparatus 8 has a controller 81, and a network interface 83. The controller 81 and network interface 83 are connected to each other via bus lines or the like. The controller 81 has a CPU 811, and a memory 813. The memory 813 is a storage medium that allows reading and writing of information, such as flash ROM or EEPROM. The memory 813 stores a program 815. The controller 81 executes various process with the CPU 811 operating according to the program 815. The program 815 includes application software for instructing the controller 81 to implement processes to exchange various information with the contract management server 7.

<Sample Operations on the Image Formation System>

Figure 6:
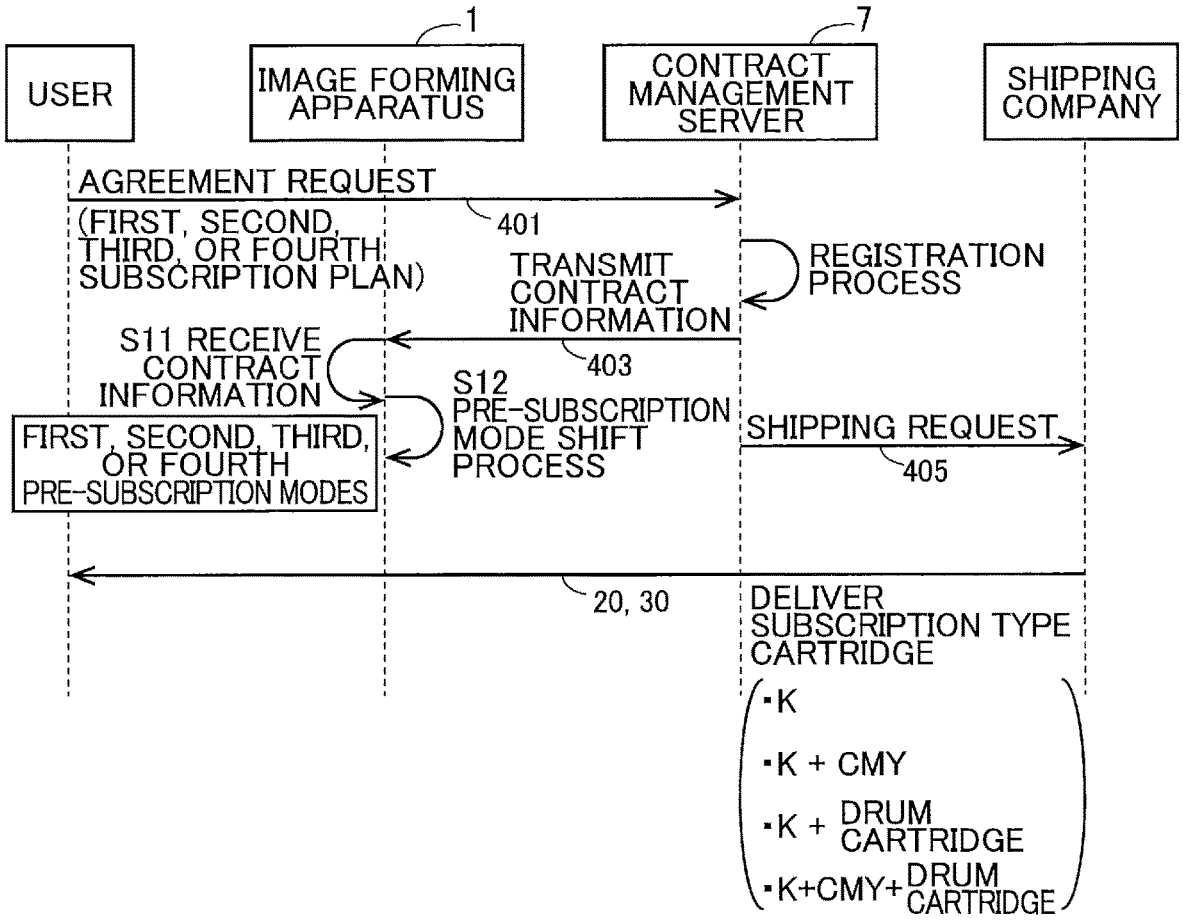
FIG. 6 is a sequence diagram illustrating a process executed in the image forming system in a case where the user joins a subscription plan.

FIG. 6 shows a process executed on the image formation system 100 in a case where the user joins a subscription plan. In a case where the user joins a specific subscription plan, the user performs an operation on the registration apparatus 8 to transmit an agreement request 401 to the contract management server 7. The agreement request 401 may include information about the user (user information and address information), information representing the subscription plan which the user wishes to join (one of the first through fourth subscriptions), payment information, and device information for identifying the image forming apparatus 1 used by the user (a device ID). Note that the user need not transmit the agreement request 401 via the registration apparatus 8. For example, the image forming apparatus 1 may be configured to transmit the agreement request 401 to the contract management server 7.

The contract management server 7 receives the agreement request 401, records the user information, the device information, the payment information, and the subscription plan information in the management information 731 based on the agreement request 401. The contract management server 7, which receives the agreement request 401, also transmits contract information 403 to the image forming apparatus 1 that is the subject of the subscription. Based on the agreement request 401, the contract management server 7 identifies the image forming apparatus 1 to which the contract information 403 is to be transmitted. The contract information 403 includes a command for instructing the controller 51 to switch its operation mode to the pre-subscription mode corresponding to the subscription plan indicated in the agreement request 401.

The controller 51 of the image forming apparatus 1 receives the contract information 403 (contract information reception process of S11). In a case where the controller 51 receives the contract information 403, the controller 51 switches its operation mode to either one of the first through fourth pre-subscription modes (pre-subscription mode shift process of S12) corresponding to either one of the first through fourth subscriptions represented in the contract information 403. The contract information 403 is information indicating that an agreement is entered for the image forming apparatus 1.

When receiving the agreement request 401, the contract management server 7 also transmits a shipping request 405 to a server of a shipping company. The shipping request 405 is information requesting the shipping company to ship one or more subscription-type cartridges to the user. The shipping request 405 includes information of the shipping destination (the user's name and address), and information identifying the types of cartridges to be shipped. The cartridges to be shipped are only those subscription-type cartridges registered as the subscription subjects according to the individual subscription plans. When the server for the shipping company receives the shipping request 405, the shipping company ships one or more new subscription-type cartridges to the user based on the shipping request 405. Through this process, the user can attach each subscription-type cartridge corresponding to the user's subscription plan in the image forming apparatus 1.

As shown in FIG. 5, the contract management server 7 may record information representing the specific pre-subscription mode in the management information 731 as the operation mode information. For example, in a case where the contact management server 7 receives the agreement request 401, the contract management server 7 may record in the management information 731 operation mode information indicating the pre-subscription that corresponds to the agreement request 401. Alternatively, when executing the pre-subscription mode shift process of S12, the controller 51 may notify the contract management server 7 that the controller 51 enters a specific pre-subscription mode. Accordingly, the contract management server 7 may record operation mode information indicating this pre-subscription mode in the management information 731 based on the notification from the image forming apparatus 1.

To change subscription plans, the user may transmit a request to change plans to the contract management server 7 through the registration apparatus 8. In a case where the contact management server 7 receives the request to change plans, the contract management server 7 may transmit the contract information 403 corresponding to the new subscription plan to the image forming apparatus 1. The controller 51 of the image forming apparatus 1 may then switch operation modes to the pre-subscription mode corresponding to the new subscription plan based on the contract information 403 received from the contract management server 7.

To cancel an agreement, the user may transmit a cancel request to the contract management server 7 through the registration apparatus 8. In a case where the contract management server 7 receives the cancel request, the contract management server 7 may transmit to the image forming apparatus 1 the contract information 403 instructing the controller 51 to switch to the normal mode. When receiving the contract information 403, the controller 51 may then switch to the normal mode.

<Pre-Subscription Mode Processes>

Figure 7:
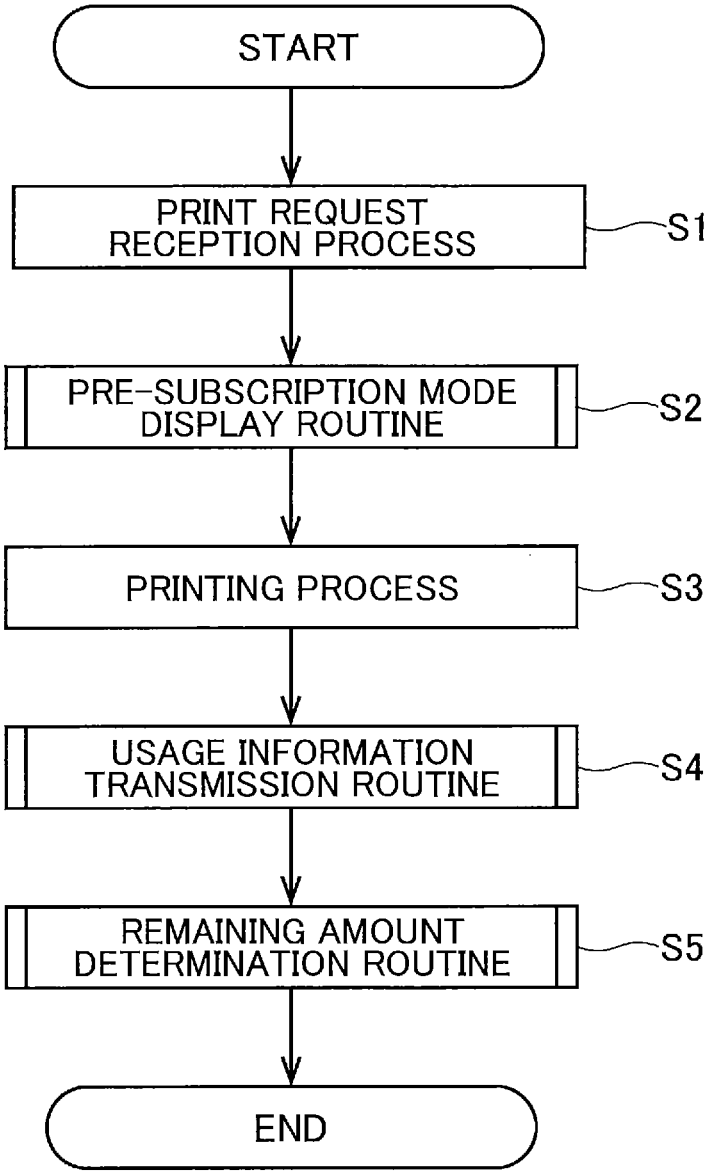
FIG. 7 is a flowchart illustrating a process executed in a pre-subscription mode by a controller.
Figure 8:
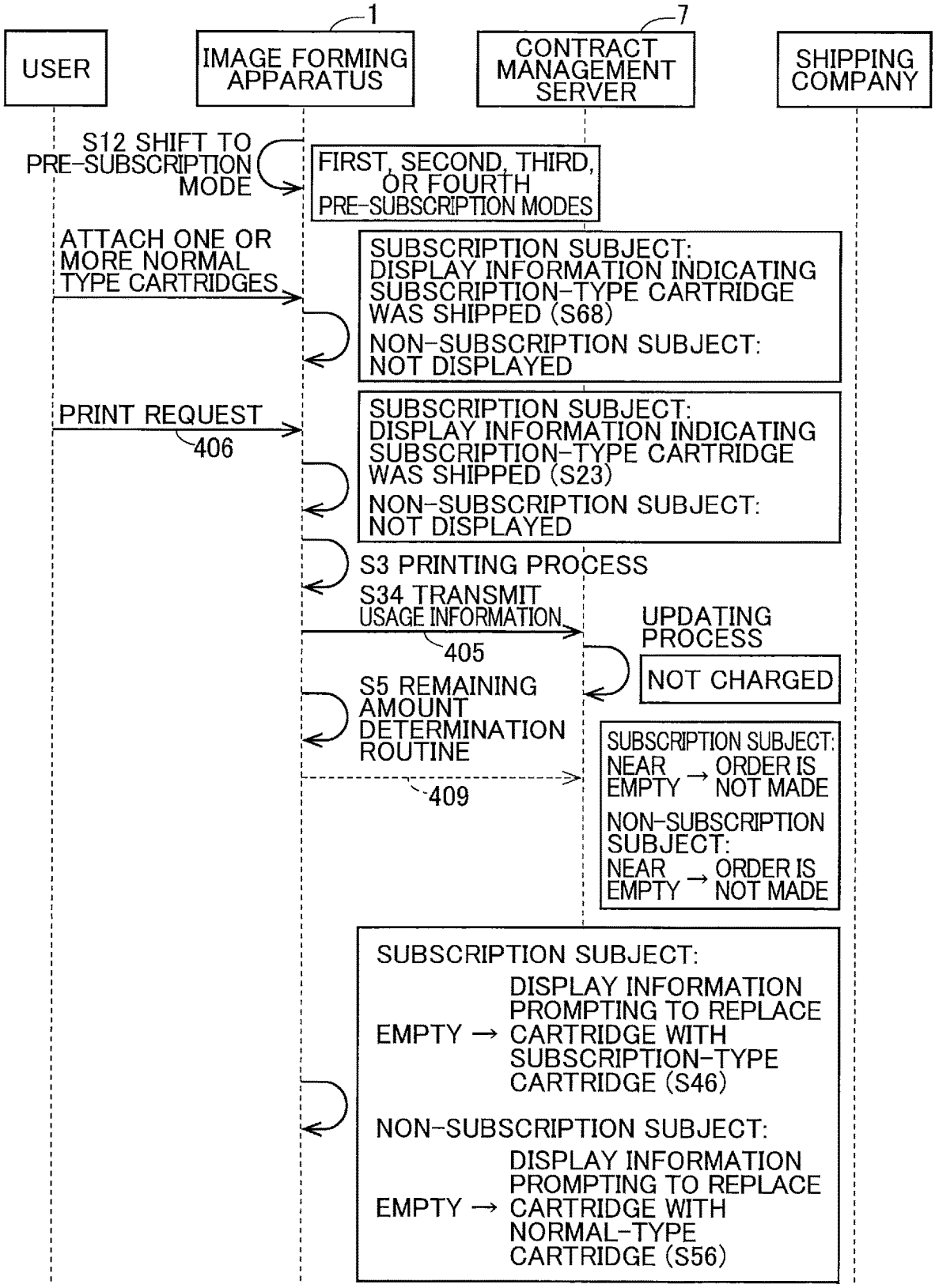
FIG. 8 is a sequence diagram illustrating a process executed in the image forming system.
Figure 9:
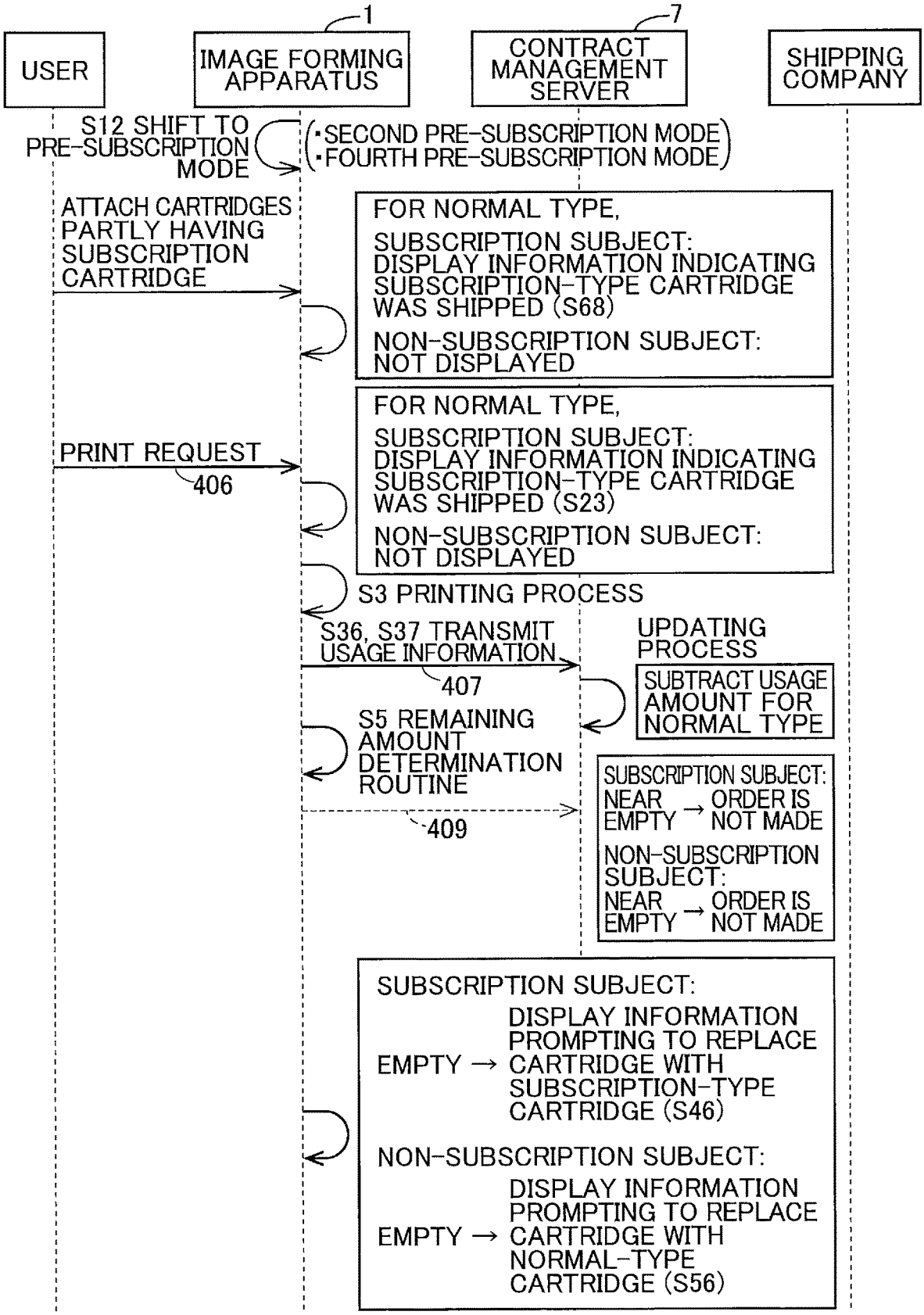
FIG. 9 is a sequence diagram illustrating a process executed in the image forming system.

FIG. 7 shows a process executed by the controller 51 in the pre-subscription mode. FIGS. 8 and 9 show processes executed on the image formation system 100. Here, FIG. 8 shows processes performed in a case where the one or more cartridges of the normal type are currently used on the image forming apparatus 1 for the cartridges of the subscription subjects. FIG. 9 shows processes performed in a case where the combination of the cartridges of the normal type and the cartridges of the subscription types are currently used on the image forming apparatus 1 for the cartridges of the subscription subjects.

After completing the pre-subscription mode shift process of S12 described above, in Si at the beginning of FIG. 7 the controller 51 executes a print request reception process. In the print request reception process, the controller 51 receives from the user a print request 406 to execute printing in the image forming apparatus 1 (see FIGS. 8 and 9). The print request 406 includes print data representing the image to be printed in the image forming apparatus 1. The print data defines types of toner (cyan, magenta, yellow, and black) to be used in printing.

When receiving the print request 406 in S1, in S2 the controller 51 executes a pre-subscription mode display routine. This pre-subscription mode display routine will be described later.

After completing the pre-subscription mode display routine in S2, in S3 the controller 51 executes a printing process to form images on printing paper using the attached cartridges based on the print data. In the printing process of S3, the controller 51 also updates life information for each cartridge in the device memory 513 according to the usage of each cartridge used during printing.

After completing the printing process of S3, in S4 the controller 51 executes a usage information transmission routine. As will be described later, the controller 51 performs the usage information transmission routine in S4 to transmit usage information 407 to the contract management server 7 (see FIG. 8 or 9). The usage information 407 represents a usage amount for each cartridge used in the printing process. After completing the usage information transmission routine of S4, in S5 the controller 51 executes a remaining amount determination routine. The remaining amount determination routine is performed to determine the amount of life remaining for each cartridge.

<Pre-Subscription Mode Display Routine>

Figure 10:
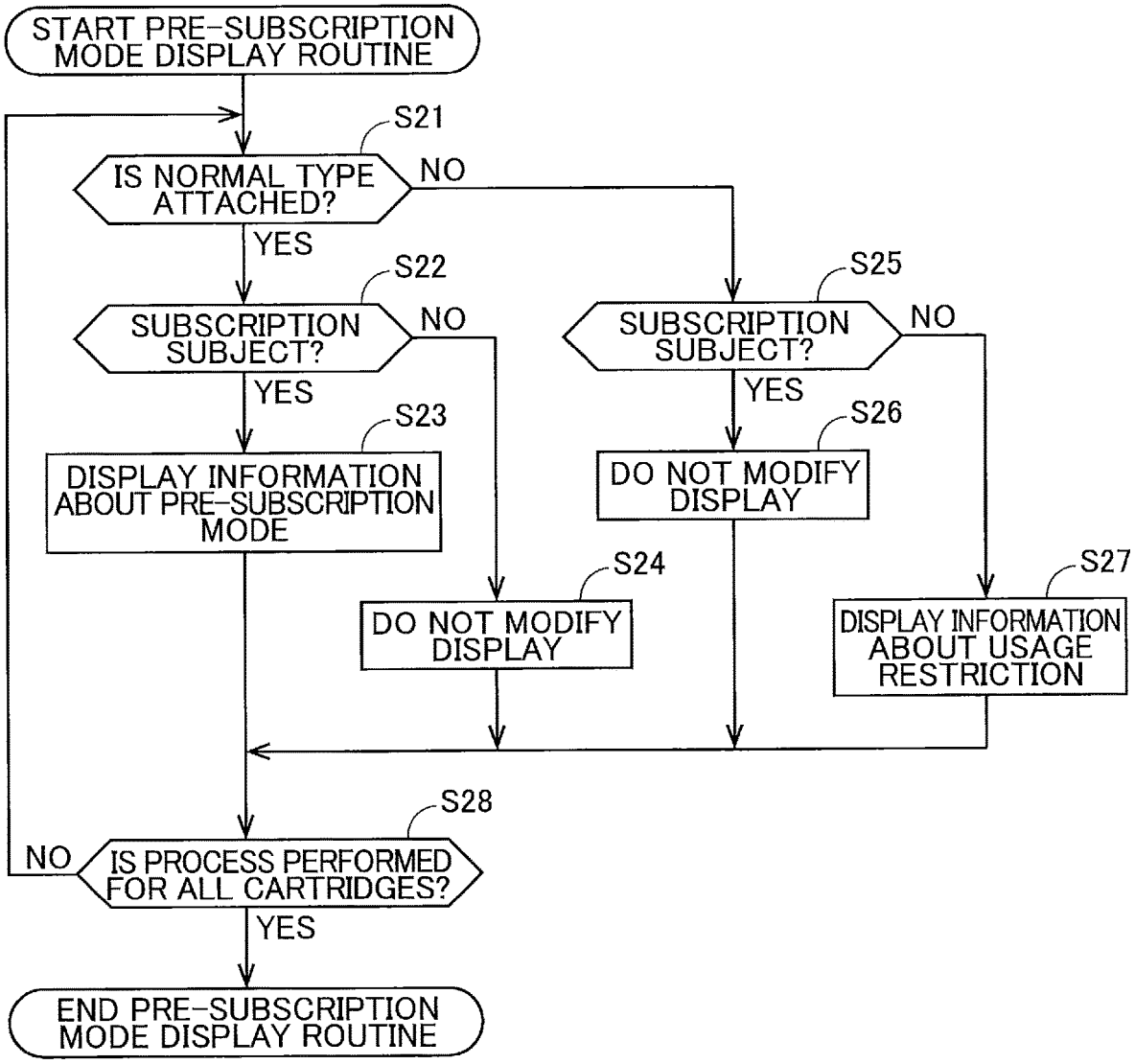
FIG. 10 is a flowchart illustrating a pre-subscription mode display routine shown in FIG. 7.

FIG. 10 shows details of the pre-subscription mode display routine executed in S2 of FIG. 7. In S21 at the beginning of the routine in FIG. 10, the controller 51 selects one of the cartridges attached to the main casing 10 and identifies whether the cartridge is the normal type or the subscription type based on type information stored in the memory of the cartridge (identification process of S21). In a case where the controller 51 identifies the type of the black cartridge 30K in S21, the identification process of S21 corresponds to the first identification process. In a case where the controller 51 identifies the type of the color cartridge 30C in S21, the identification process of S21 corresponds to the second identification process. In a case where the controller 51 identifies that the cartridge is the normal type (S21: YES), in S22 the controller 51 determines whether the cartridge identified as the normal type is registered as the subscription subject (subscription determination process of S22).

In a case where the controller 51 determines in S22 that the cartridge of the normal type is registered as the subscription subject (S22: YES), in S23 the controller 51 displays on the display 55 display-information representing that use of the cartridge of the subscription type is permitted and that such a cartridge of the subscription type is currently shipped (pre-subscription mode display process of S23). Through the process of S23, the controller 51 can notify the user that the cartridge of the subscription type can be used on the image forming apparatus 1 and that the cartridge of the subscription type is currently shipped. In this way, the controller 51 can guide the user to use the cartridges of the subscription type for the cartridges registered as the subscription subjects.

In a case where the controller 51 determines in S22 that the cartridge of the normal type is not registered as the subscription subject (S22: NO), in S24 the controller 51 does not modify the display on the display 55 (skipping process of S24). By not modifying the display, the controller 51 can guide the user toward using the cartridge of the normal type for the cartridges not registered as the subscription subject.

In a case where the controller 51 identifies in S21 that the cartridge is the subscription type (S21: NO), in S25 the controller 51 determines whether the cartridge identified as the subscription type is the subscription subject (subscription determination process of S25). In a case where the controller 51 determines in S25 that the cartridge of the subscription type is the subscription subject (S25: YES), in S26 the controller 51 does not modify the display on the display 55 (skipping process of S26). However, in a case where the controller 51 determines in S25 that the cartridge of the subscription type is not registered as the subscription subject (S25: NO), in S27 the controller 51 displays on the display 55 information indicating that the cartridge of the subscription type is the non-subscription subject (use restriction display process of S27). Through the process of S27, the controller 51 can guide the user to use the cartridge of the normal type for the cartridge not registered as the subscription subject.

In addition to executing the use restriction display process of S27, the controller 51 may also prohibit usage of the cartridge which is the subscription type and is not registered as the subscription subject (prohibition process). Further, in S27 the controller 51 may display a message on the display 55 indicating that cartridge, which is the subscription type and is not registered as the subscription subject, cannot be used.

After completing one of steps S23, S24, S26, or S27, in S28 the controller 51 determines whether the process described above is performed for all cartridges attached to the image forming apparatus 1 (determination process of S28). In a case where the controller 51 determines in S28 that the process is completed for all cartridges (S28: YES), the controller 51 ends the pre-subscription mode display routine of S2. In a case where the controller 51 determines that an unprocessed cartridge remains (S28: NO), the controller 51 returns to S21 and executes the identification process for the next cartridge.

<Usage Information Transmission Routine>

Figure 11:
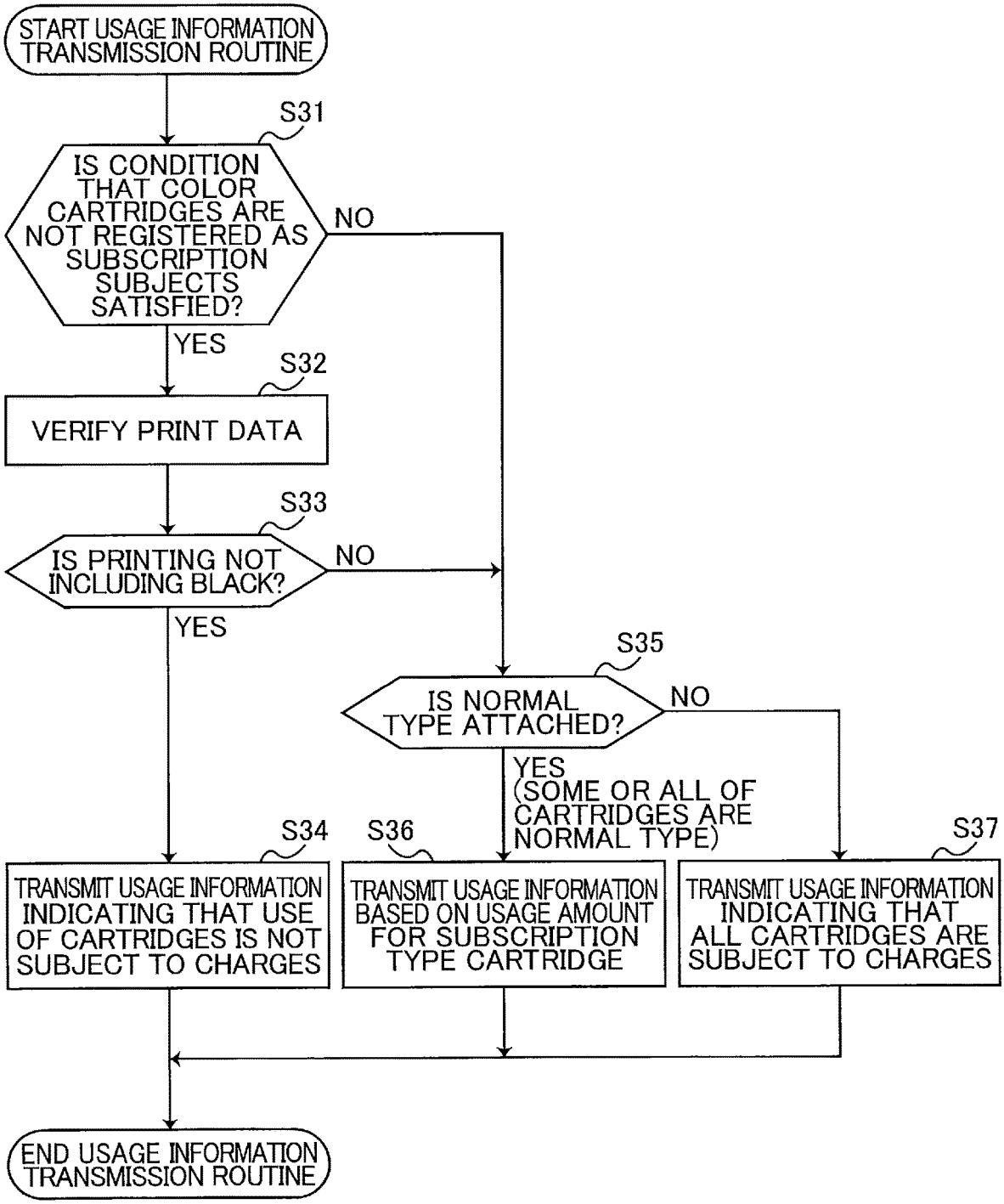
FIG. 11 is a flowchart illustrating a usage information transmission routine shown in FIG. 7.

FIG. 11 shows details of the usage information transmission routine executed in S4 of FIG. 7. In S31 at the beginning of this routine, the controller 51 determines whether a condition that the color cartridges 30C are not registered as the subscription subjects is satisfied (subscription determination process of S31). In a case where the operation mode is the first pre-subscription mode or the third subscription mode, for example, the controller 51 determines that that the condition that the color cartridges 30C are not registered as the subscription subjects is satisfied (S31: YES). In a case where the operation mode is the second subscription mode or the fourth subscription mode, for example, the controller 51 determines that the color cartridges 30C are registered as the subscription subjects (S31: NO).

In a case where the controller 51 determines that the condition that the color cartridges 30C are not registered as the subscription subjects is satisfied (S31: YES), in S32 the controller 51 verifies the content of the print data (print data verification process of S32). The print data is the data used in the printing process of S3 described above. In S33 the controller 51 determines whether the print data is color print data that does not include black (print data determination process of S33). In a case where the controller 51 determines that the print data is color print data that does not includes black (S33: YES), in S34 the controller 51 transmits to the registration apparatus 8 usage information 407 indicating that the use of cartridges in the printing process of S3 is not subject to charges (first transmission process of S34).

In a case where the controller 51 determines in S31 that the condition that the color cartridges 30C are registered as the subscription subjects is not satisfied (S31: NO) or in a case where the controller 51 determines in S33 that the print data includes black (S33: NO), in S35 the controller 51 determines whether some or all of the cartridges attached to the image forming apparatus 1 are the normal types. In a case where the controller 51 determines that some or all of the attached cartridges are the normal types (S35: YES), in S36 the controller 51 transmits usage information 407 representing the usage amount(s) for the cartridge(s) of the subscription type to the contract management server 7 (second transmission process of S36).

Take for example, the case in which the controller 51 prints one page in color (CMYK) in the printing process of S3. In this case, in a case where the black cartridge 30K is the subscription type and the color cartridges 30C are the normal type, in S36 the controller 51 transmits usage information 407 to the contract management server 7 representing the usage amount of the black cartridge 30K (e.g., ¼ page). In other words, the controller 51 transmits usage information 407 indicating a usage amount obtained by subtracting usage amounts for the normal-type color cartridges 30C (¾ page) from the total amount.

In a case where the controller 51 determines in S35 that all cartridges are the subscription type (S35: NO), in S37 the controller 51 transmits to the contract management server 7 usage information 407 indicating that all cartridges are subject to charges (third transmission process of S37). When one of the first transmission process of S34, the second transmission process of S36, and the third transmission process of S37 is executed, the controller 51 ends the usage information transmission routine of S4.

As shown in FIGS. 8 and 9, the contract management server 7 updates the management information 731 based on the usage information 407 received from the image forming apparatus 1. Specifically, the contract management server 7 adds the number of printed pages represented in the usage information 407 to the cumulated number of printed pages subject to charges in the management information 731. In a case where the printing process in S3 is performed using the normal-type cartridges as in the example of FIG. 8, the controller 51 transmits the usage information 407 to the contract management server 7 in the first transmission process of S34. In this case, the usage information 407 represents that the printing process of S3 is not the subject of charges. Hence, the contract management server 7 does not add any value to the cumulated number of printed pages. On the other hand, in a case where the printing process is performed in S3 using both the normal-type cartridge(s) and the subscription-type cartridge(s) as in the example of FIG. 9, the controller 51 transmits the usage information 407 to the contract management server 7 in the second transmission process of S36. Since the usage information 407 indicates the usage amounts of the normal-type cartridges that are subtracted from the number of printed pages in the usage information 407 in a case where both normal-type and subscription-type cartridges are used, the contract management server 7 adds the number of printed pages, which is obtained by subtracting the usage of normal-type cartridges, to the cumulated number of printed pages which is the subject of billings. In this way, usage amounts of normal cartridges are deducted when fees are charged in the image formation system 100.

<Remaining Amount Determination Routine>

Figure 12:
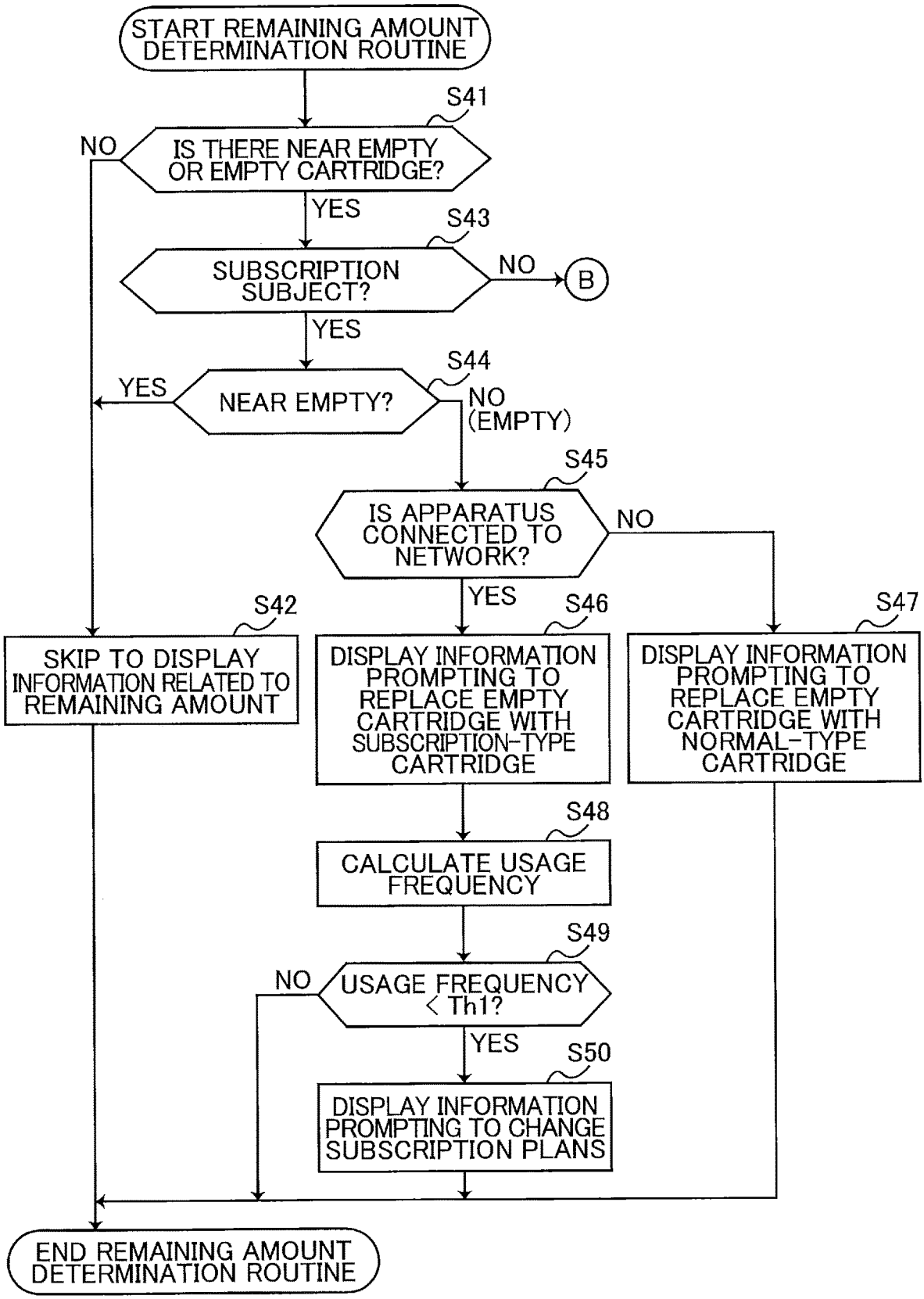
FIG. 12 is a flowchart illustrating a part of a remaining amount determination routine shown in FIG. 7.
Figure 13:
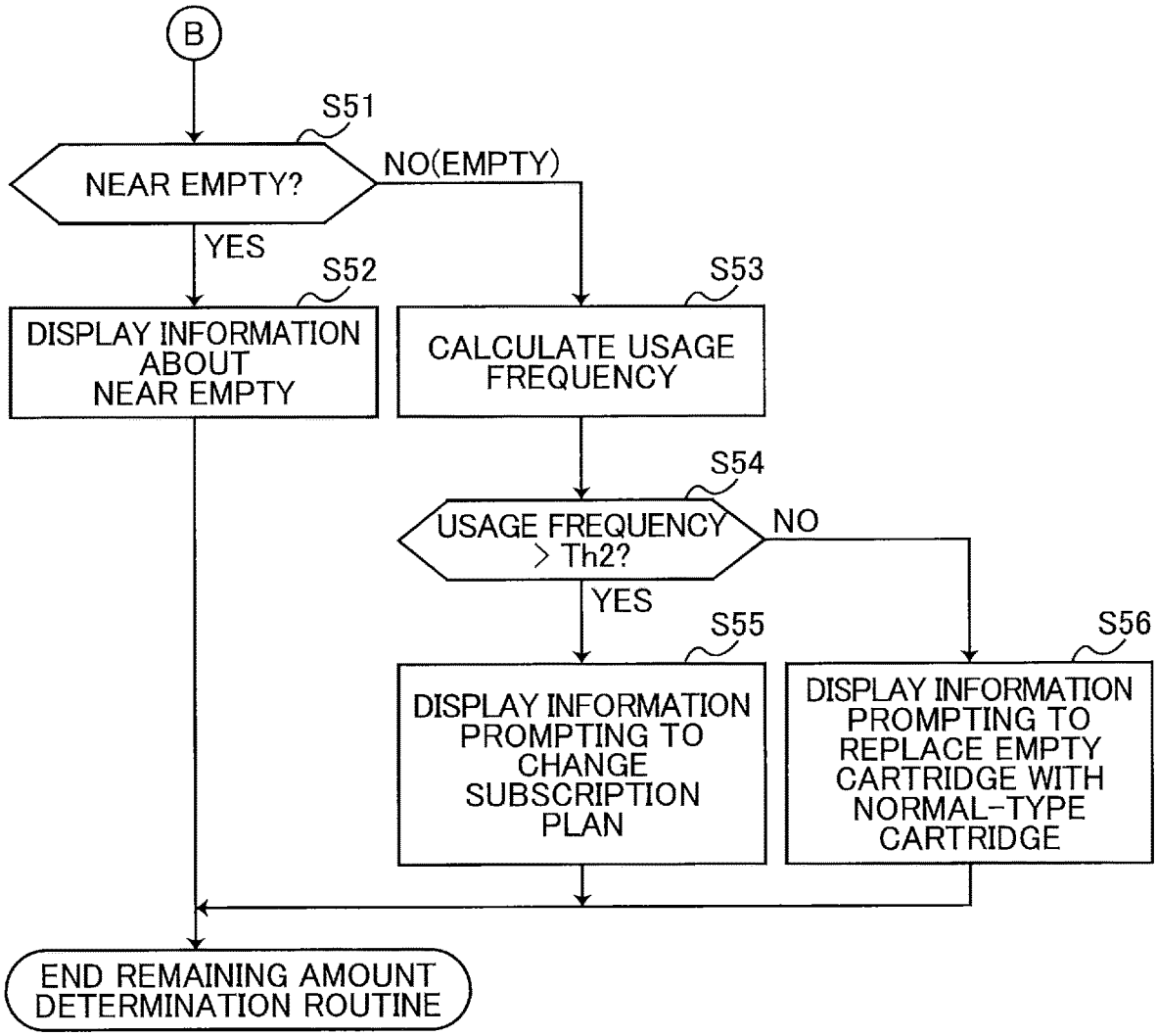
FIG. 13 is a flowchart illustrating a remaining part of the remaining amount determination routine shown in FIG. 7.

FIGS. 12 and 13 show details of the remaining amount determination routine in S5 of FIG. 7. In S41 of FIG. 12, the controller 51 determines based on life information whether any cartridges are "near empty" or "empty" (remaining amount determination process of S41). "Empty" denotes a state in which the cartridge has no remaining life, i.e., a state in which the cartridge must be replaced. "Near empty" denotes a state in which the remaining life of the cartridge is nearly exhausted, i.e., a state in which the cartridge will soon need to be replaced. The controller 51 determines whether each cartridge is empty or near empty based on corresponding threshold values.

The device memory 513 may store a threshold value corresponding to a near empty state for each cartridge. In S41 the controller 51 may determines that a cartridge is near empty in a case where the life information for the cartridge exceeds the threshold value corresponding to a near empty state. The device memory 513 may also store a threshold value corresponding to an empty state for each cartridge. In S41 the controller 51 may determines that a cartridge is empty in a case where the life information for the cartridge exceeds the threshold value corresponding to an empty state.

In a case where the controller 51 determines in S41 that no cartridges are near empty or empty (S41: NO), in S42 the controller 51 skips the process to display information related to the remaining amount determination (skipping process of S42) and ends the remaining amount determination routine of S5. However, in a case where the controller 51 determines in S41 that a cartridge is near empty or empty (S41: YES), in S43 the controller 51 determines whether the cartridge determined to be near empty or empty is the subscription subject (subscription determination process of S43).

In a case where the controller 51 determines in S43 that the near empty or empty cartridge is the subscription subject (S43: YES), in S44 the controller 51 determines whether the cartridge as the subscription subject is near empty (FIG. 12: status determination process of S44). In a case where the controller 51 determines in S44 that the cartridge as the subscription subject is near empty (S44: YES), in S42 the controller 51 skips the process to display information related to the remaining amount determination (skipping process of S42) and ends the remaining amount determination routine of S5.

By not displaying information in a case where the cartridge of the subscription subject is near empty, the controller 51 can restrain the user from replacing a usable subscription-type cartridge with a new cartridge. In this way, the controller 51 can guide the user to continue using the subscription-type cartridge until the cartridge becomes empty.

In a case where the controller 51 determines in S44 that the cartridge of the subscription subject is empty (S44: NO), in S45 the controller 51 determines whether the image forming apparatus 1 is currently connected to a network (connection determination process of S45). In other words, the controller 51 determines in S45 whether the image forming apparatus 1 can communicate with the contract management server 7.

In a case where the controller 51 determines in S45 that the image forming apparatus 1 is currently connected to the network (S45: YES), in S46 the controller 51 displays on the display 55 display-information prompting the user to replace the empty cartridge with a new subscription-type cartridge (subscription-type cartridge replacement display process of S46). Hence, in a case where the cartridge of the subscription subject is empty, in S46 the controller 51 can guide the user to replace the cartridge with a new subscription-type cartridge.

In a case where the controller 51 determines in S45 that the image forming apparatus 1 is not connected to a network (S45: NO), in S47 the controller 51 displays on the display 55 display-information prompting the user to replace the empty cartridge with a new normal-type cartridge (normal-type cartridge replacement display process of S47). In a case where the image forming apparatus 1 is not connected to the network, it is difficult to manage the usage amount. Hence, by executing the normal-type cartridge replacement display process of S47, the controller 51 can guide the user to replace the cartridge with a normal-type cartridge that the contract management server 7 does not need to manage.

After completing the subscription-type cartridge replacement display process of S46, in S48 the controller 51 calculates the usage frequency of the cartridge determined to be empty within a prescribed interval (usage frequency calculation process of S48). The controller 51 calculates the usage frequency within the prescribed interval based on the toner information or the drum information stored in the device memory 513, for example. The controller 51 may also find the usage frequency based on the number of printed pages represented in the life information. In S49 the controller 51 determines whether the usage frequency within the prescribed interval found in S48 is less than a threshold value Th1 (FIG. 12: usage frequency determination process of S49).

In a case where the controller 51 determines in S49 that the usage frequency is less than the threshold value Th1 (S49: YES), in S50 the controller 51 displays on the display 55 display-information prompting the user to change plans (FIG. 12: plan change display process of S50).

Specifically, in S50 the controller 51 displays on the display 55 display-information prompting the user to cancel the current subscription plan or to change to a subscription plan in which the cartridge whose usage frequency is less than the threshold value Th1 is not the subscription subject. Take for example, the case in which the user joins the second subscription and the usage frequency of the color cartridges 30C is less than the threshold value Th1. In this case, the controller 51 may display on the display 55 display-information prompting the user to change subscription plans to the first subscription in which the color cartridges 30C are not the subscription subjects.

In other words, a user whose cartridge usage within the prescribed interval is relatively low may benefit more from using normal-type cartridges than from joining the subscription plan to use the subscription-type cartridges of the subscription subjects. By executing the process in S49 and S50, the controller 51 can guide the user to join the subscription plan best suited to the user's usage frequency for each cartridge.

In a case where the controller 51 determines in S49 that the usage frequency is greater than or equal to the threshold value Th1 (S49: NO), the controller 51 ends the remaining amount determination routine of S5.

On the other hand, in a case where the controller 51 determines in S43 that the near empty or empty cartridge is not registered as the subscription subject (S43: NO), in S51 of FIG. 13 the controller 51 determines whether the cartridge not registered as the subscription subject is near empty (FIG. 13: status determination process of S51). In a case where the controller 51 determines in S51 that the cartridge not registered as the subscription subject is near empty (S51: YES), in S52 the controller 51 displays on the display 55 display-information indicating that the cartridge not registered as the subscription subject is near empty (FIG. 13: near empty display process of S52). Thus, in a case where the cartridge not registered as the subscription subject becomes near empty, the controller 51 can notify the user that the remaining life of the cartridge is running out soon, i.e., that the cartridge will soon need to be replaced. After completing the near empty display process of S52, the controller 51 ends the remaining amount determination routine of S5.

In a case where the controller 51 determines in S51 that the cartridge not registered as the subscription subject is empty (S51: NO), in S53 the controller 51 calculates the usage frequency within the prescribed interval for the cartridge determined to be empty (FIG. 13: usage frequency calculation process of S53). The controller 51 may also find the number of printed pages by using the empty cartridge as the usage frequency for the empty cartridge, for example. In S54 the controller 51 determines whether the usage frequency within the prescribed interval found in S53 is greater than a threshold value Th2 (FIG. 13: usage frequency determination process of S54). In a case where the controller 51 determines in the usage frequency determination process of S54 that the usage frequency is greater than the threshold value Th2 (S54: YES), in S55 the controller 51 displays on the display 55 display-information prompting the user to change the subscription plan (FIG. 13: plan change display process of S55).

In the plan change display process of S55 the controller 51 displays on the display 55 display-information indicating a suggested subscription plan for the user. The suggested subscription plan is a plan that registers as the subscription subject the cartridge determined in S54 to have a usage frequency greater than the threshold value Th2. Take for example, the case in which the user joins the first subscription and the usage frequency for the color cartridges 30C is greater than the threshold value Th2. In this case, the controller 51 may display on the display 55 the display-information prompting the user to switch to the second subscription which registers the color cartridges 30C as the subscription subjects. In other words, in some cases a user that uses certain cartridges relatively frequently within the prescribed interval may benefit more from using subscription-type cartridges. Therefore, by executing the processes of S54 and S55 the controller 51 can suggest a subscription plan to the user that is more suited to the user's usage frequency for those cartridges. After completing the plan change display process in S55, the controller 51 ends the remaining amount determination routine of S5.

However, in a case where the controller 51 determines in S54 that the usage frequency of the cartridge within the prescribed interval is less than or equal to the threshold value Th2 (S54: NO), in S56 the controller 51 displays on the display 55 display-information prompting the user to replace the empty cartridge with a normal-type cartridge (normal-type cartridge replacement display process of S56). By executing the normal-type cartridge replacement display process of S56 in a case where the cartridge not registered as subscription subject becomes empty, the controller 51 can guide the user to replace the cartridge with a normal-type cartridge. After completing the normal-type cartridge replacement display process of S56, the controller 51 ends the remaining amount determination routine of S5.

<Transitioning to a Subscription Mode>

Figure 14:
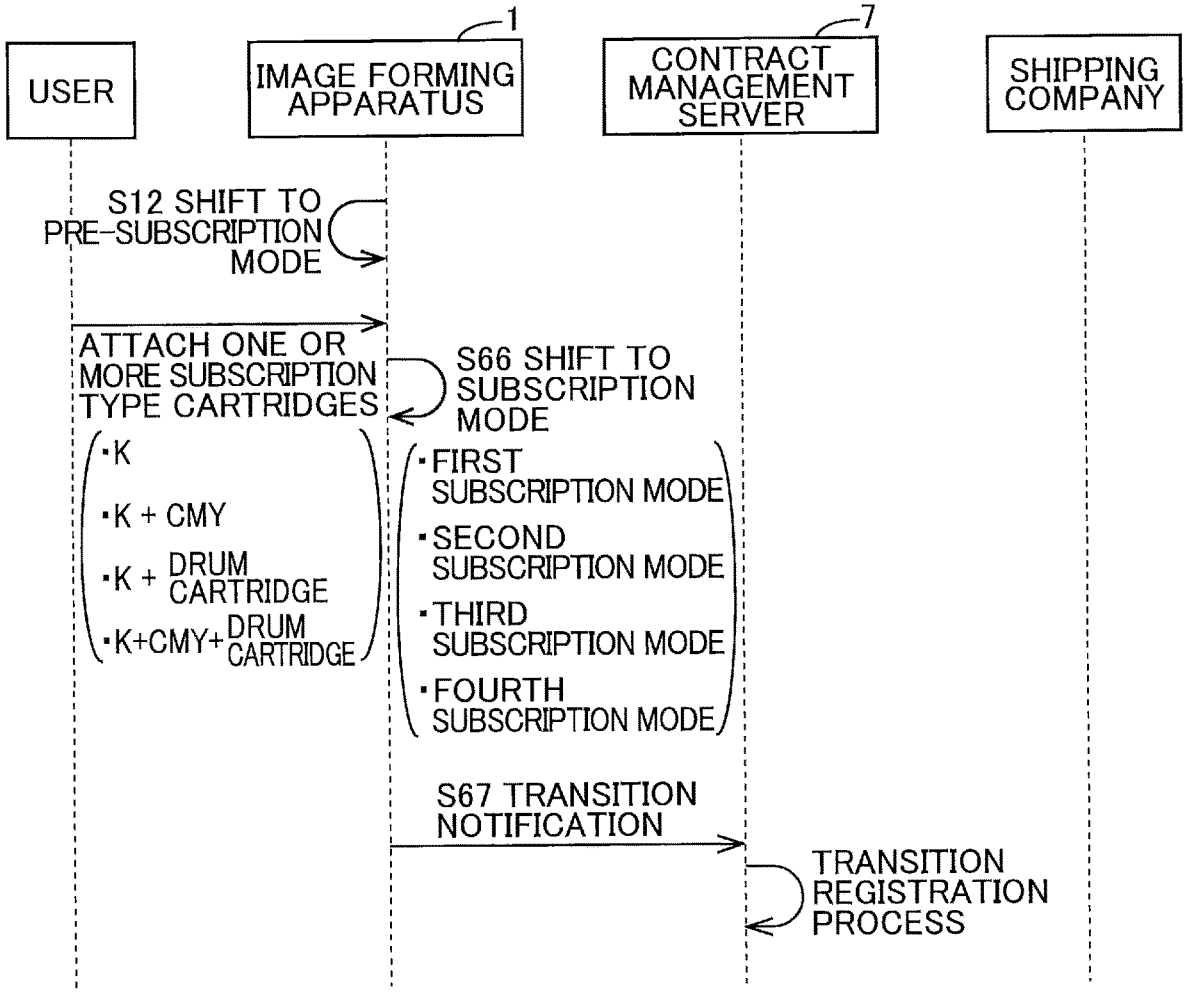
FIG. 14 is a sequence diagram illustrating a process executed in the image forming system in a case where the image forming apparatus shifts to a subscription mode.
Figure 15:
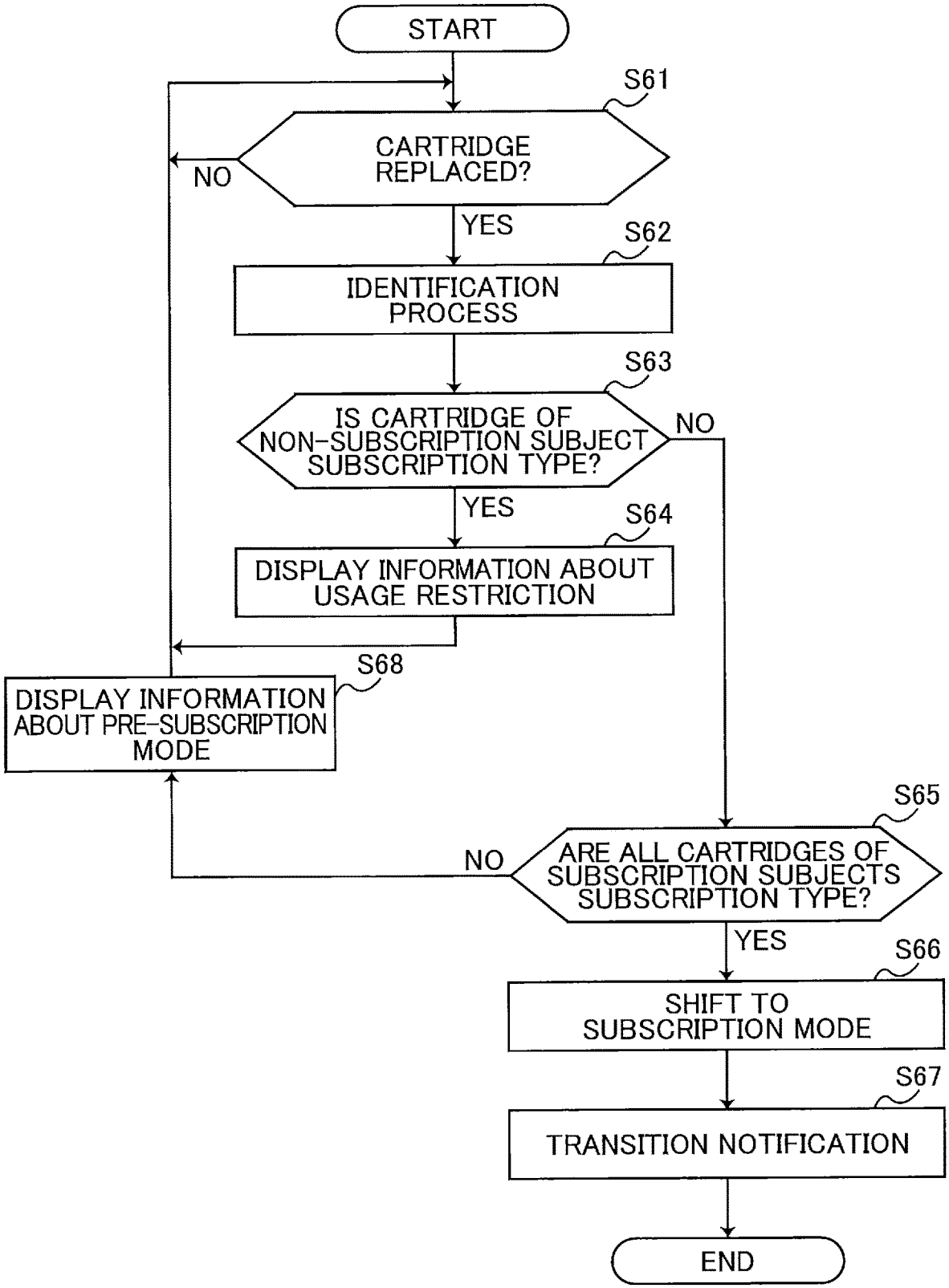
FIG. 15 is a flowchart illustrating a process in which the controller of the image forming apparatus shifts to the subscription mode from the pre-subscription mode.

FIG. 14 shows the process executed in the image formation system 100 for switching the image forming apparatus 1 to the subscription mode. FIG. 15 shows steps in the process executed by the controller 51 of the image forming apparatus 1 for switching the operation mode from the pre-subscription mode to the subscription mode.

As shown in FIG. 14, in a case where the user joins a subscription plan and replaces all cartridges registered as the subscription subjects with the subscription-type cartridges, the controller 51 of the image forming apparatus 1 switches from the pre-subscription mode to the subscription mode. More specifically, as shown in FIG. 15, in S61 the controller 51 of the image forming apparatus 1 in the pre-subscription mode determines whether the cartridge is replaced (replacement determination process of S61). The controller 51 may determine that a cartridge is replaced in a case where detecting that the power supply for the image forming apparatus 1 switches from ON to OFF or from OFF to ON, in a case where the image forming apparatus 1 is woken from a sleep state, or in a case where the cover sensor 12 detects that the cover 11 moved from the closed position to the open position.

The controller 51 may also determine whether each cartridge is replaced based on their ID information. For example, the controller 51 may access the memory (the toner memory 32 or the drum memory 22) of each cartridge periodically and determine whether the ID information (toner ID or drum ID) stored in the memory of each cartridge matches ID information stored in the device memory 513. Here, the controller 51 may determine that a cartridge is replaced in a case where the ID information does not match, and determine that a cartridge is not replaced in a case where the ID information matches.

In a case where the controller 51 determines in S61 that a cartridge is replaced (S61: YES), in S62 the controller 51 identifies whether the type information for each cartridge mounted in the main casing 10 is the normal type or the subscription type (identification process of S62). The identification process of S62 corresponds to the first identification process in which the controller 51 identifies the type of the black cartridge 30K based on identification information stored in the toner memory 32 (the black toner memory). The identification process of S62 also corresponds to the second identification process in which the controller 51 identifies the types of the color cartridges 30C based on the type information stored in the toner memories 32 (the color toner memories).

In S63 the controller 51 determines whether the cartridge not registered as the subscription subject is identified to be the subscription type in the identification process of S62 (subscription determination process of S63). In a case where the controller 51 determines in S63 that the cartridge not registered as the subscription subject is the subscription type (S63: YES), in S64 the controller 51 displays on the display 55 display-information indicating that use of the cartridge, which is identified as the subscription-type and is not registered as the subscription subject, is restricted (use restriction display process of S64). For example, in S64 the controller 51 may display on the display 55 display-information indicating that use of the cartridge, which is identified as the subscription-type and is not registered as the subscription subject, is prohibited or display-information prompting the user to replace the subscription-type cartridge with a normal-type cartridge. After completing the use restriction display process of S64, the cover 11 returns to S61.

However, in a case where the controller 51 determines in S63 that a cartridge not registered as the subscription subject is the normal type (S63: NO), in S65 the controller 51 determines whether all cartridges registered as the subscription subjects are the subscription type (subscription determination process of S65). In a case where the controller 51 determines in S65 that all cartridges registered as the subscription subjects are subscription type (S65: YES), in S66 the controller 51 switches to the subscription mode (subscription mode transition process of S66).

In a case where the operation mode is the first pre-subscription mode, only the black cartridge 30K is registered as the subscription subject. Therefore, in a case where the controller 51 determines in S63 that the color cartridges 30C and the drum cartridges 20 are the normal type and determines in S65 that the black cartridge 30K is the subscription type, in S66 the controller 51 switches to the first subscription mode. In a case where the operation mode is the second pre-subscription mode, both the black cartridge 30K and the color cartridges 30C are registered as the subscription subject. Therefore, in a case where the controller 51 determines in S63 that the drum cartridges 20 are the normal type and determines in S65 that both the black cartridge 30K and the color cartridges 30C are the subscription type, then in S66 the controller 51 switches to the second subscription mode.

In a case where the controller 51 determines in S65 that not all cartridges registered as the subscription subjects are the subscription type (S65: NO), in S68 the controller 51 displays on the display 55 display-information related to the pre-subscription mode (pre-subscription mode display process of S68). In other words, the controller 51 executes the pre-subscription mode display process in S68 in a case where the controller 51 determines in S65 that at least one of the cartridges registered as the subscription subject is the normal type. In pre-subscription mode display process of S68, the controller 51 displays on the display 55 display-information indicating that the subscription-type cartridge can be used for the cartridge registered as the subscription subject and that the subscription-type cartridge is currently shipped to the user. Through the process in S68, the controller 51 can guide the user to use the subscription-type cartridges. After completing the pre-subscription mode display process of S68, the controller 51 returns to the replacement determination process of S61.

After completing the subscription mode transition process of S66, in S67 the controller 51 notifies the contract management server 7 that the image forming apparatus 1 enters the subscription mode (subscription mode transition notification process of S67). As shown in FIG. 14, in response to receiving this notification, the contract management server 7 records in the management information 731 information indicating that the image forming apparatus 1 has entered the subscription mode.

<Subscription Mode Processes>

Figure 16:
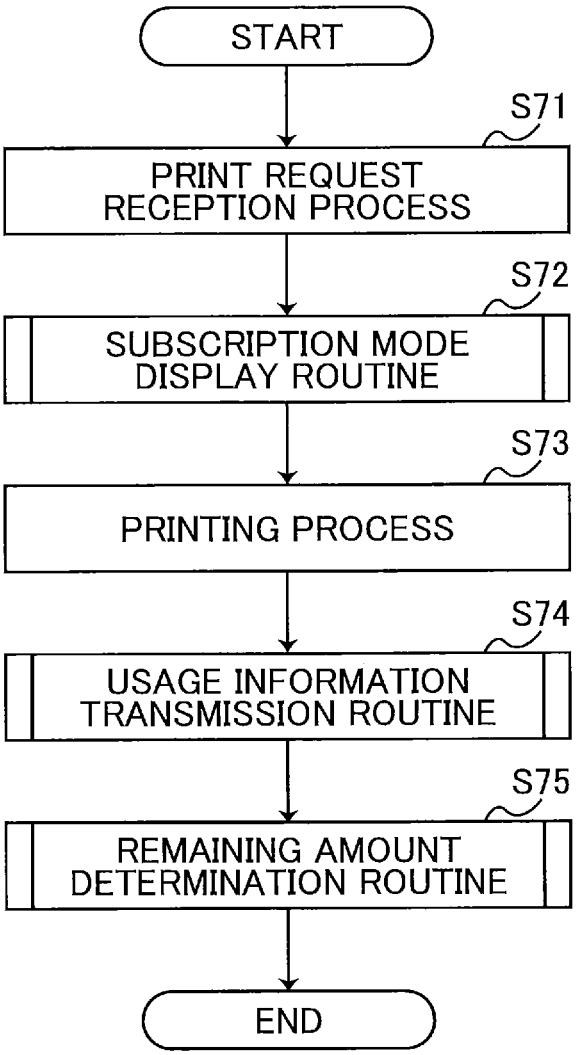
FIG. 16 is a flowchart illustrating a process executed by the controller in the subscription mode.
Figure 17:
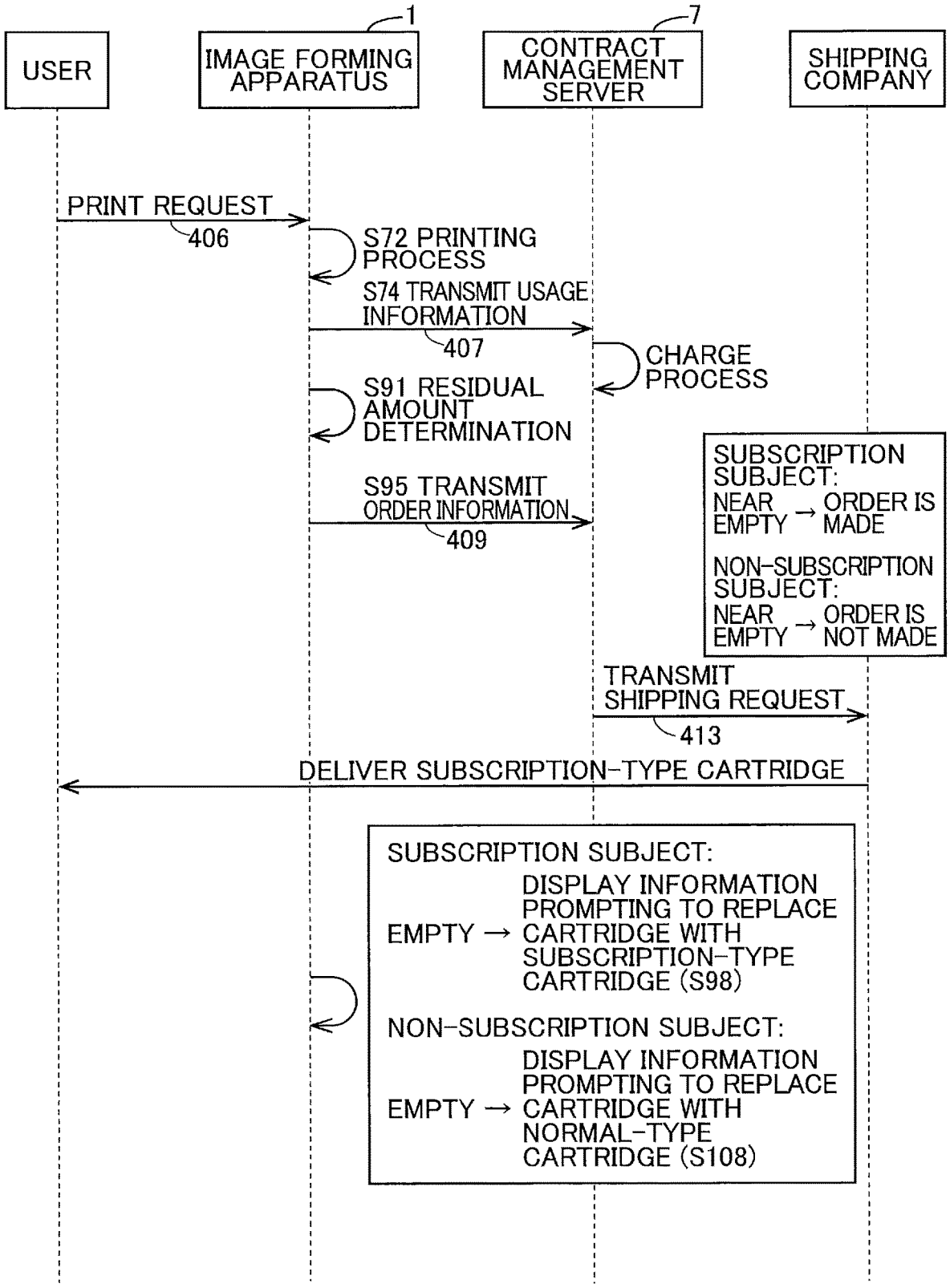
FIG. 17 is a sequence diagram illustrating a process executed in the image forming system.

FIG. 16 shows a process executed by the controller 51 in the subscription mode. FIG. 17 shows the process executed on the image formation system 100. In S71 of FIG. 16, the controller 51 of the image forming apparatus 1 in the subscription mode performs a process to receive a print request 406 (FIG. 16: print request reception process of S71). The process of S71 is identical to the print request reception process of Si described in FIG. 7.

After receiving the print request 406 in S71, the controller 51 executes a subscription mode display routine in S72 described later. After completing the process of S72, in S73 the controller 51 executes a printing process based on the print data represented in the print request 406. The printing process of S73 is identical to S3 in FIG. 7.

After completing the printing process, the controller 51 executes the usage information transmission routine of S74. The usage information transmission routine of S74 is identical to the usage information transmission routine of S4 of FIG. 7. After completing the usage information transmission routine of S74, in S75 the controller 51 executes a remaining amount determination routine. This routine will be described later.

<Subscription Mode Display Routine of S72>

Figure 18:
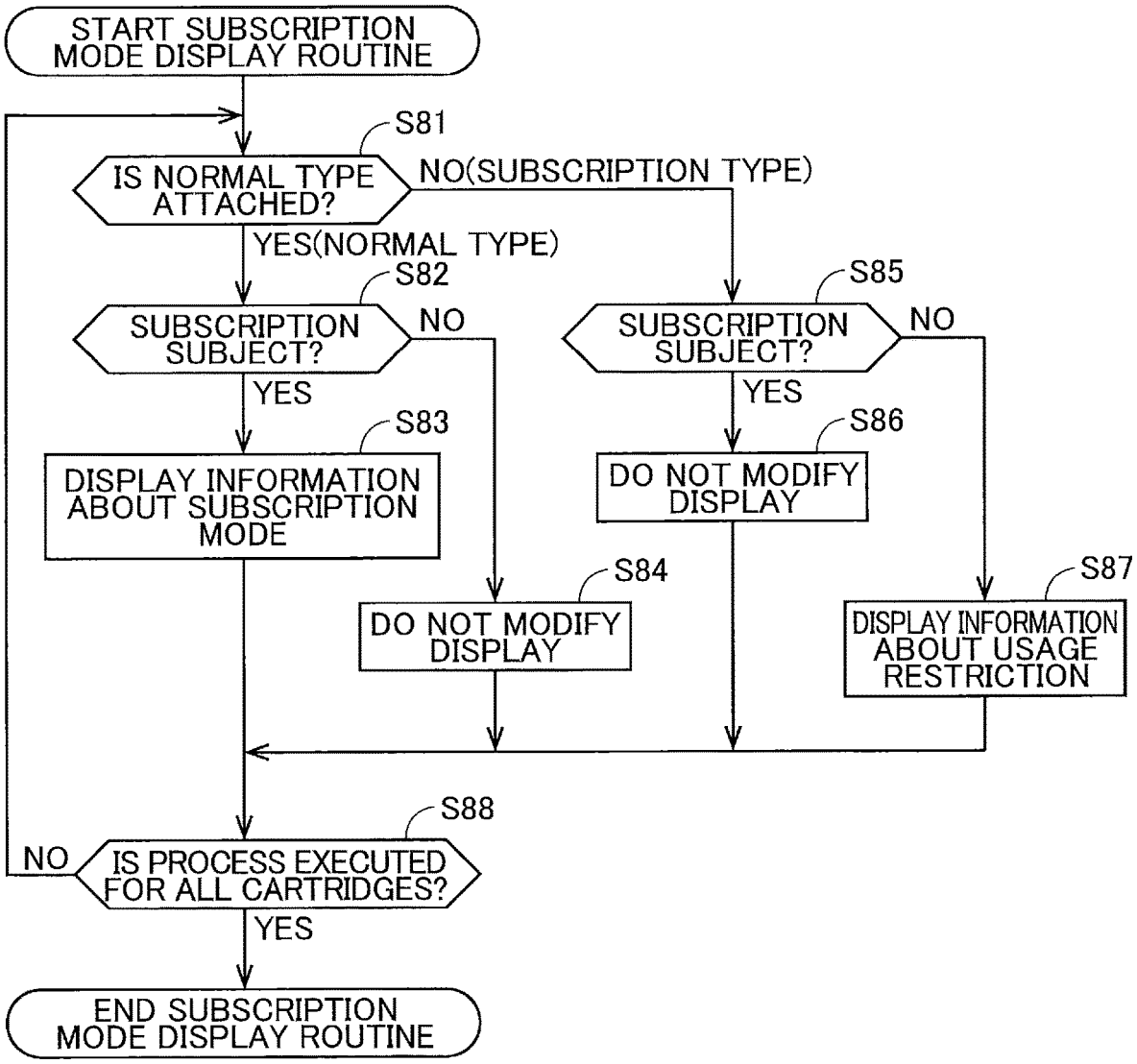
FIG. 18 is a flowchart illustrating a subscription mode display routine shown in FIG. 16.

FIG. 18 shows details for the subscription mode display routine in S72 of FIG. 16. In S81 at the beginning of this routine, the controller 51 selects one of the cartridges attached to the main casing 10 and identifies whether the type information for the cartridge indicates the normal type or the subscription type (identification process of S81).

In a case where the controller 51 identifies the cartridge to be the normal type (S81: YES), in S82 the controller 51 determines whether the cartridge identified as the normal type is registered as the subscription subject (subscription determination process of S82).

In a case where the controller 51 determines in S82 that the cartridge of the normal type is registered as the subscription subject (S82: YES), in S83 the controller 51 displays on the display 55 display-information indicating that the subscription-type cartridge can be used (subscription mode display process of S83). In this way, in S83 the controller 51 can prompt the user to use the subscription-type cartridge for the cartridge registered as the subscription subject.

In a case where the controller 51 determines in S82 that the cartridge of the normal type is not registered as the subscription subject (S82: NO), in S84 the controller 51 maintains the display on the display 55 without change (skipping process of S84). By not changing the display on the display 55, the controller 51 can guide the user to continue using the normal-type cartridge for the cartridge not registered as the subscription subject.

In a case where the controller 51 identifies in S81 that the attached cartridge is the subscription type (S81: NO), in S85 the controller 51 determines whether the cartridge identified as the subscription type is registered as the subscription subject (subscription determination process of S85). In a case where the controller 51 in S85 determines that the cartridge of the subscription type is registered as the subscription subject (S85: YES), in S86 the controller 51 does not change the display on the display 55 (skipping process of S86). However, in a case where the controller 51 determines in S85 that the cartridge of the subscription type is not registered as the subscription subject (S85: NO), in S87 the controller 51 displays on the display 55 display-information indicating that the subscription-type cartridge attached to the main casing 10 is not registered as the subscription subject (use restriction display process of S87). Through the process of S87, the controller 51 can guide the user not to use the cartridge of the subscription type for cartridges not registered as the subscription subject.

After completing one of the subscription mode display process of S83, the skipping process of S84, the skipping process of S86, and the use restriction display process of S87, in S88 the controller 51 determines whether the identification process of S81 is executed for all cartridges. In a case where the controller 51 determines that the identification process of S81 is executed for all cartridges (S88: YES), the controller 51 ends the subscription mode display routine of S72. In a case where the controller 51 determines that the identification process is not executed for all cartridges (S81: NO), the controller 51 returns to the process of S81.

Take for example, the case in which the color cartridge 30C attached to the main casing 10 is replaced with the subscription-type cartridge. In this case, in a case where the operation mode is the second subscription mode, the controller 51 determines in S85 that the color cartridge 30C is registered as the subscription subject under the current plan and executes the skipping process of S86. Hence, in a case where the operation mode is in the second subscription mode, the controller 51 does not perform any process to restrict use of the subscription-type color cartridges 30C. On the other hand, in a case where the operation mode is the first subscription mode, the controller 51 determines in S85 that the color cartridge 30C is not registered as the subscription subject and executes the use restriction display process of S87. Thus, the controller 51 restricts use of the color cartridges 30C in a case where the operation mode is in the first subscription mode and the type information of the color cartridge 30C indicates the subscription type, compared to a case where the operation mode is the second subscription mode and the type information of the color cartridge 30C indicates the subscription type.

<Remaining Amount Determination Routine of S75>

Figure 19:
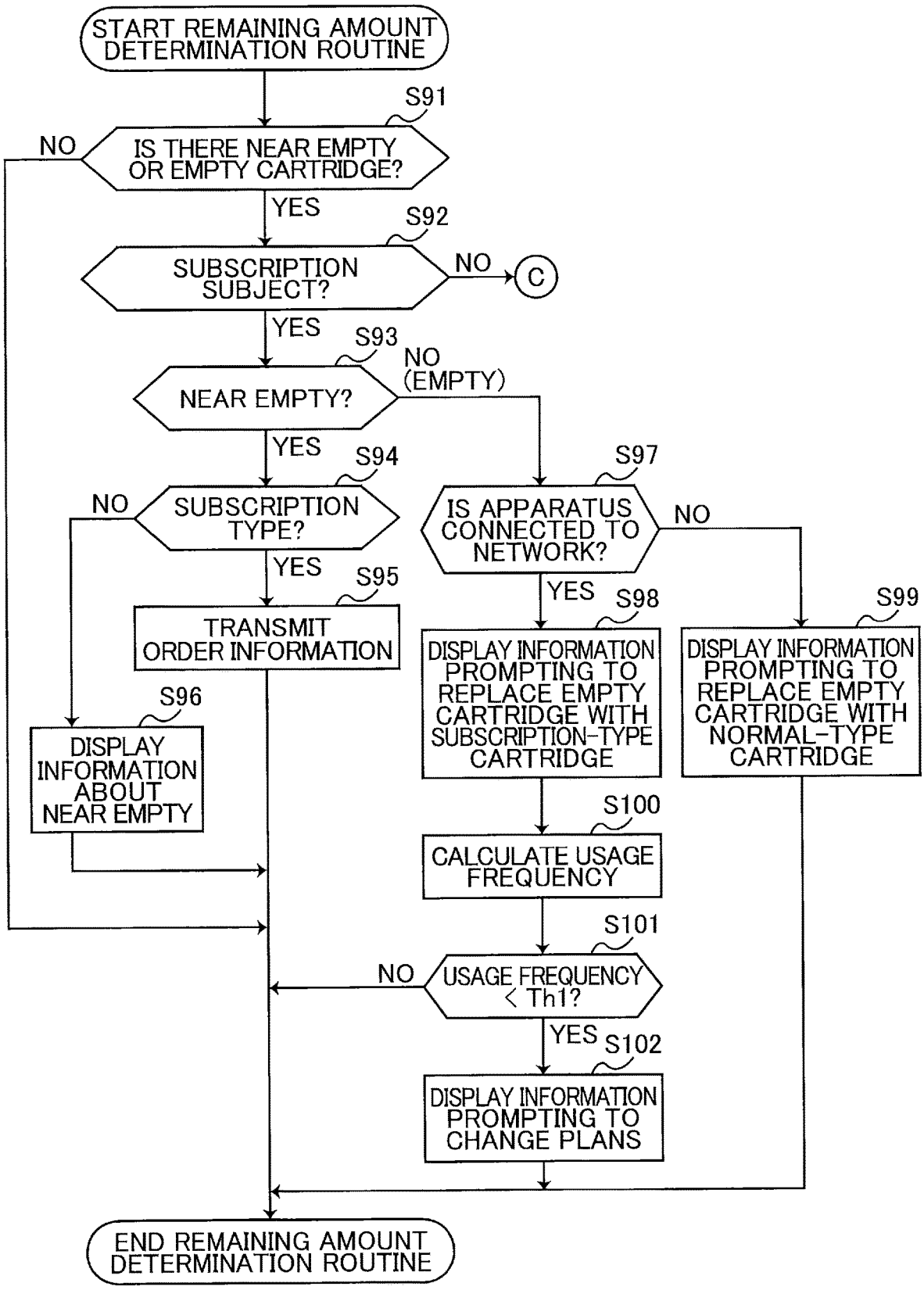
FIG. 19 is a flowchart illustrating a part of a remaining amount determination routine shown in FIG. 16.
Figure 20:
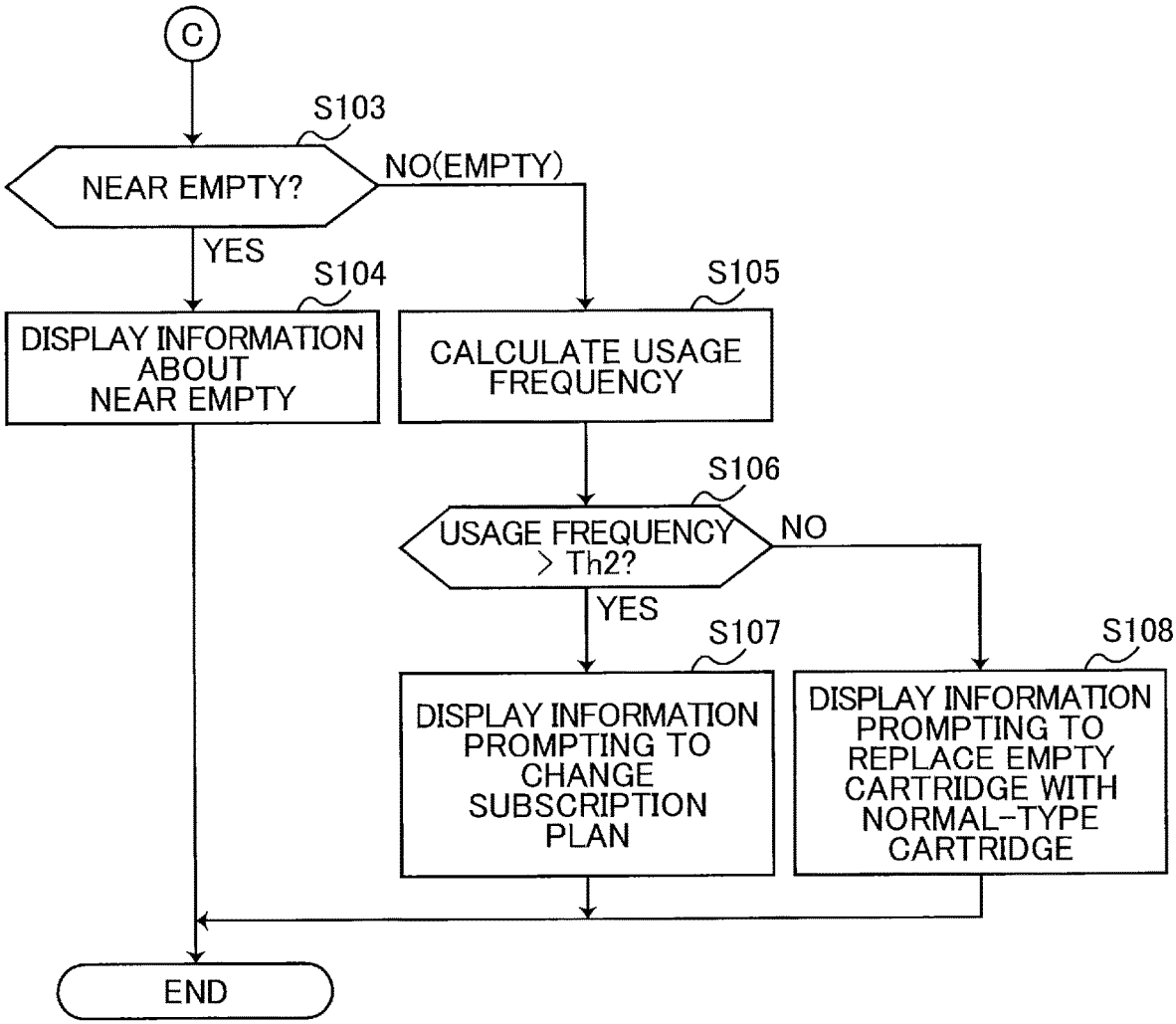
FIG. 20 is a flowchart illustrating a remaining part of the remaining amount determination routine shown in FIG. 16.

FIGS. 19 and 20 show details of the remaining amount determination routine in S75 of FIG. 16. In S91 of FIG. 19 at the beginning of the remaining amount determination routine, the controller 51 determines whether any of the attached cartridges are near empty or empty (remaining amount determination process of S91). The process of S91 is identical to the remaining amount determination process of S41 of FIG. 12. In a case where the controller 51 determines that none of the cartridges are near empty or empty (S91: NO), the controller 51 ends the remaining amount determination routine of S75. In a case where the controller 51 determines that there is a cartridge that is near empty or empty (S91: YES), in S92 the controller 51 determines whether the near empty or empty cartridge is registered as the subscription subject (subscription determination process of S92).

In a case where the controller 51 determines that the near-empty or empty cartridge is registered as the subscription subject (S92: YES), in S93 the controller 51 determines whether the cartridge is in the near empty state (status determination process of S93). In a case where the controller 51 determines that the cartridge registered as the subscription subject is in the near empty state (S93: YES), in S94 the controller 51 determines whether the cartridge which is registered as the subscription subject and determined to be near empty, is the subscription type (determination process of S94).

In a case where the controller 51 determines in S94 that the near empty cartridge registered as the subscription subject is the subscription type (S94: YES), in S95 the controller 51 transmits order information 409 to the contract management server 7 (FIG. 19: order information transmission process of S95). The order information 409 is information used to place an order for a new subscription-type cartridge identical to the type of cartridge determined to be near empty.

As shown in FIG. 17, the contract management server 7, which receives the order information 409, transmits a shipping request 413 to the server of the shipping company. The shipping request 413 is information requesting the shipping company to ship a new subscription-type cartridge to the user. Specifically, the shipping request 413 includes information of the shipping destination, such as the name and address of the user, and information indicating the type of the subscription-type cartridge to be shipped. When receiving the shipping request 413, the shipping company ships the new subscription-type cartridge to the user based on the shipping request 413.

As described with reference to FIGS. 12 and 13, the controller 51 does not transmit order information 409 in a case where the operation mode is set to the pre-subscription mode, regardless of whether the cartridge determined to be near empty is registered or not registered as the subscription subject. Consequently, as shown in FIG. 8 or 9, a new subscription-type cartridge is not shipped to the user of the image forming apparatus 1 when the image forming apparatus 1 is in the pre-subscription mode, even when a cartridge registered as the subscription subject becomes near empty. After completing the order information transmission process of S95 or a near empty display process of S96 (described below), the controller 51 ends the remaining amount determination routine of S75.

In a case where the controller 51 determines in S94 that the cartridge, which is determined to be registered as the subscription subject and near empty, is the normal type (S94: NO), in S96 the controller 51 displays information on the display 55 indicating that the cartridge identified as the normal type is near empty (near empty display process of S96). In a case where the cartridge registered as the subscription subject is the normal type, the controller 51 does not transmit the order information 409 to the contract management server 7. Hence, a new subscription-type cartridge is not shipped to the user in this case.

In a case where the controller 51 determines in S93 that the cartridge registered as the subscription subject is empty (S93: NO), in S97 the controller 51 determines whether the image forming apparatus 1 is currently connected to a network (connection determination process of S97). In the connection determination process of S97, the controller 51 determines whether the image forming apparatus 1 can communicate with the contract management server 7.

In a case where the controller 51 determines that the image forming apparatus 1 is currently connected to the network (S97: YES), in S98 the controller 51 displays on the display 55 display-information prompting the user to replace the empty cartridge with a new subscription-type cartridge (FIG. 19: subscription-type cartridge replacement display process of S98). In a case where the cartridge registered as the subscription subject is empty, the controller 51 can guide the user to replace the empty cartridge with a new subscription-type cartridge by executing the subscription-type cartridge replacement display process of S98.

However, in a case where the controller 51 determines in S97 that the image forming apparatus 1 is not connected to the network (S97: NO), in S99 the controller 51 displays on the display 55 display-information prompting the user to replace the empty cartridge with a new normal-type cartridge (FIG. 19: normal-type cartridge replacement display process of S99). Here, usage of the subscription-type cartridge cannot be managed easily on the contract management server 7 in a case where the image forming apparatus 1 is not connected to the network. Hence, the controller 51 can guide the user to replace the empty cartridge with a normal-type cartridge that does not need to be managed by executing the normal-type cartridge replacement display process of S99. After executing the normal-type cartridge replacement display process of S99, the controller 51 ends the remaining amount determination routine of S75.

After completing the subscription-type cartridge replacement display process of S98, in S100 the controller 51 calculates the usage frequency within a prescribed interval for the cartridge determined to be empty (usage frequency calculation process of S100). In S101 the controller 51 determines whether the usage frequency within the prescribed interval found in S100 is less than the threshold value Th1 (usage frequency determination process of S101). In a case where the controller 51 determines that the usage frequency is less than the threshold value Th1 (S101: YES), the controller 51 executes a plan change display process of S102. The usage frequency calculation process of S100, the usage frequency determination process of S101, and the plan change display process of S102 are respectively identical to those of S48, S49, and S50 shown in FIG. 12.

In a case where the controller 51 determines in S101 that the usage frequency is greater than or equal to the threshold value Th1 (S101: NO), the controller 51 ends the remaining amount determination routine of S75. The controller 51 also ends the remaining amount determination routine of S75 after completing the plan change display process of S102.

In a case where the controller 51 determines in S92 that the near empty or empty cartridge is not registered as the subscription subject (S92: NO), in S103 of FIG. 20 the controller 51 determines whether the cartridge not registered as the subscription subject is near empty (FIG. 20: status determination process of S103). In a case where the controller 51 determines that the cartridge not registered as the subscription subject is near empty (S103: YES), in S104 the controller 51 displays on the display 55 display-information indicating that the cartridge not registered as the subscription subject is near empty (near empty display process of S104). After completing the near empty display process of S104, the controller 51 ends the remaining amount determination routine of S75.

In a case where the cartridge not registered as the subscription subject becomes near empty, the controller 51 can notify the user through the near empty display process of S104 that the remaining life of the cartridge is about to run out and that the cartridge must be replaced soon. Hence, by executing the near empty display process of S104 the controller 51 can guide the user to prepare a new cartridge.

In a case where the operation mode is the first subscription mode and the controller 51 determines that the black cartridge 30K (registered as the subscription subject) is near empty and the subscription type (S93: YES, S94: YES), in the order information transmission process of S95, the controller 51 transmits the order information 409 to the contract management server 7. Therefore, in a case where the subscription-type black cartridge 30K becomes near empty under the first subscription, a new subscription-type black cartridge 30K is shipped to the user (see FIG. 17). On the other hand, in a case where the operation mode is the first subscription mode and the controller 51 determines that the color cartridge 30C (not registered as the subscription subject) is near empty (S103: YES), the controller 51 does not transmit the order information 409. Accordingly, under the first subscription a new color cartridge 30C is not shipped to the user when the current color cartridge 30C becomes near empty because the color cartridges 30C are not registered as the subscription subject in the first subscription.

In a case where the controller 51 determines in S103 that a cartridge not registered as the subscription subject is empty (S103: NO), in S105 the controller 51 calculates the usage frequency within the prescribed interval for the cartridge determined to be empty (FIG. 20: usage frequency calculation process of S105). In S106 the controller 51 determines whether the usage frequency found in S105 is greater than the threshold value Th2 (FIG. 20: usage frequency determination process of S106). In a case where the controller 51 determines that the usage frequency within the prescribed interval is greater than the threshold value Th2 (S106: YES), in S107 the controller 51 displays on the display 55 display-information prompting the user to change subscription plans (plan change display process of S107). The usage frequency calculation process of S105, the usage frequency determination process of S106, and the plan change display process of S107 are identical to those of S53, S54, and S55 shown in FIG. 13.

In a case where the controller 51 determines in S106 that the usage frequency within the prescribed interval is less than or equal to the threshold value Th2 (S106: NO), in S108 the controller 51 displays on the display 55 display-information prompting the user to replace the empty cartridge with the normal-type cartridge (normal-type cartridge replacement display process of S108). After completing the normal-type cartridge replacement display process of S108, the controller 51 ends the remaining amount determination routine of S75.

Figure 21:
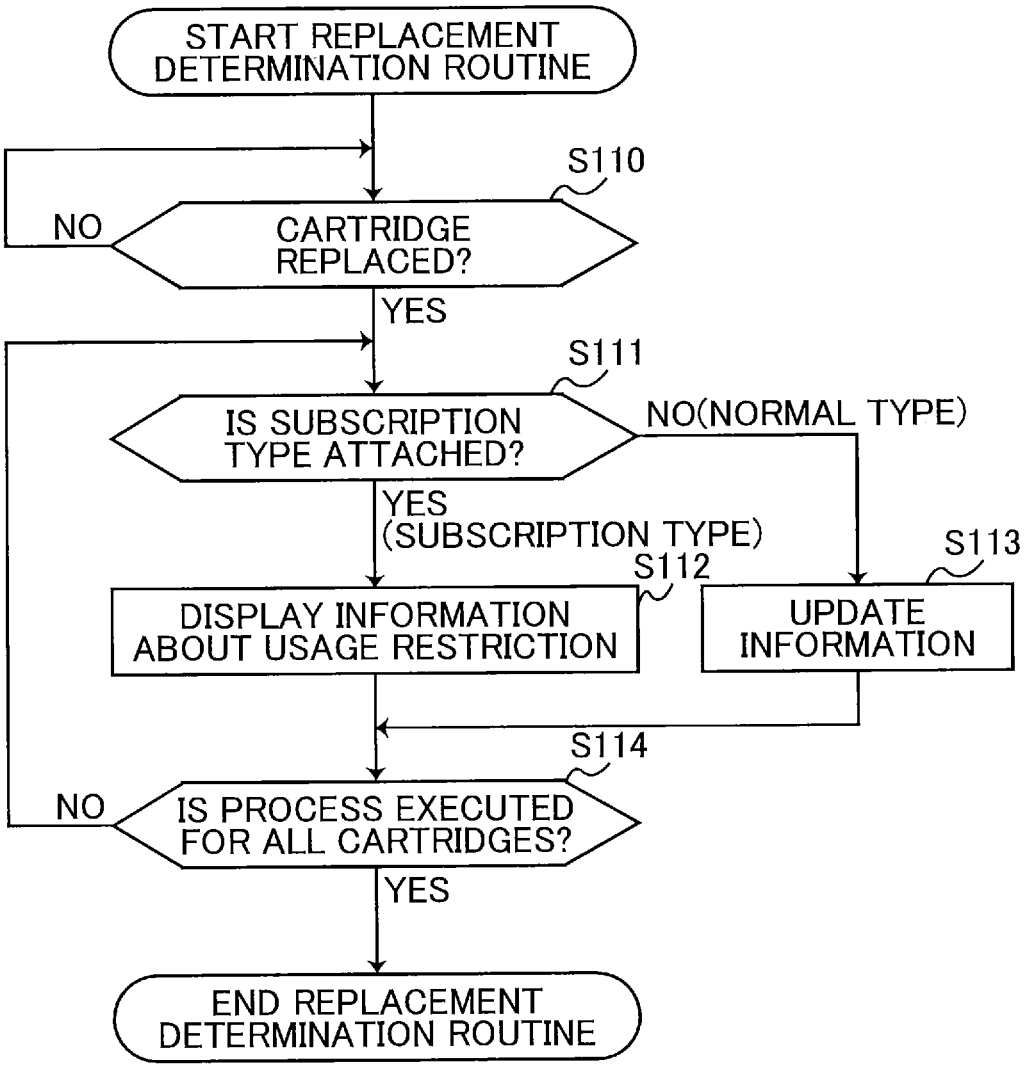
FIG. 21 is a flowchart illustrating a replacement determination routine executed by the controller in a normal mode.

FIG. 21 shows details of a replacement determination routine executed by the controller 51 in the normal mode. In S110 at the beginning of the replacement determination routine, the controller 51 determines whether a cartridge is replaced (replacement determination process of S110). The replacement determination process of S110 is identical to the replacement determination process of S61 in FIG. 15.

In a case where the controller 51 determines in S110 that the cartridge is replaced (S110: YES), in S111 the controller 51 selects one of the cartridges attached to the main casing 10 and identifies whether the cartridge is the subscription type (identification process of S111). In a case where the controller 51 determines that the cartridge is the subscription type (S111: YES), in S112 the controller 51 displays on the display 55 display-information indicating that the use of the subscription-type cartridge is restricted (use restriction display process of S112). For example, in S112 the controller 51 may display on the display 55 display-information indicating that use of the subscription-type cartridges is prohibited and prompting the user to replace the subscription-type cartridge with a normal-type cartridge. Through the process of S112, the controller 51 can suppress the user from using the subscription-type cartridges on an uncontracted image forming apparatus 1.

In a case where the controller 51 identifies the cartridge to be a normal type (S111: NO), in S113 the controller 51 updates information of the cartridge (toner information or drum information) stored in the device memory 513 based on information stored in the memory of the cartridge (updating process of S113).

After completing the use restriction display process of S112 or the toner information or drum information of S113, in S114 the controller 51 determines whether the identification process of S111 is executed for all cartridges (determination process of S114). In a case where the controller 51 determines that the identification process of S111 is executed for all the cartridges (S114: YES), the controller 51 ends the replacement determination routine in FIG. 21. In a case where the controller 51 determines that the identification process of S111 is not executed for at least one cartridge (S114: NO), the controller 51 returns to the process of S111.

2. Modifications

The disclosure is not limited the embodiment described above, and various modifications can be made therein.

As shown in FIG. 11, the controller 51 of the image forming apparatus 1 according to the embodiment determines the usage amount for each cartridge subject to charges. However, the contract management server 7 instead may determine the usage amount for each cartridge subject to charges. In this case, the controller 51 may transmit a usage amount and identification information for each cartridge used in printing to the contract management server 7 as usage information.

As described in FIG. 19, the controller 51 of the image forming apparatus 1 according to the embodiment determines whether to order a new cartridge by determining whether a cartridge found to be near empty is registered as the subscription subject. However, the contract management server 7 instead may determine whether to order a new cartridge. For example, in a case where the controller 51 determines that a cartridge is near empty, the controller 51 may transmit the type of cartridge that is near empty and its identification information to the contract management server 7 as order information. The contract management server 7 may determine whether to order a new subscription-type cartridge by determining whether the near empty cartridge is registered as the subscription subject based on the order information received from the image forming apparatus 1.

The contract management server 7 is an example of the communication apparatus, but the communication apparatus is not limited to the contract management server 7. The communication apparatus may be any information terminal, such as a personal computer, a smartphone, or a tablet computer. The controller 51 of the image forming apparatus 1 may transmit the order information to the information terminal. In this case, the information terminal may transmit the order information to the contract management server 7. Alternatively, e-mail may be used for data communications among devices.

In the embodiment, the controller 51 shifts to the subscription mode through the pre-subscription mode, but the controller 51 need not shift to the pre-subscription mode. In other words, the controller 51 may directly shift between the normal mode and the specific subscription mode corresponding to the subscription plan.

Subscription plans that register the transfer unit 40 (the transfer belt 41) as the subscription subject may also be provided. In this case, the transfer unit 40 includes memory for storing identification information representing one of that the transfer unit 40 is the normal type or that the transfer unit 40 is a subscription type, and the controller 51 may perform a process to read this identification information from the memory.

The photosensitive drum 21 may alternatively be provided in the toner cartridge 30 rather than the drum cartridge 20.

The drum cartridge 20 may also be configured so that a plurality of toner cartridges 30 is attachable thereto. In this case, a single drum cartridge 20 is includes a plurality of photosensitive drums 21 having a one-on-one correspondence with the plurality of toner cartridges 30.

The image forming apparatus may also be an inkjet printer. In the inkjet printer, the printer may utilize a black cartridge including a casing for accommodating black ink (printing material), and color cartridges including casings for accommodating color ink.

The image formation system may include a subscription plan that registers the drum cartridges 20 as the subscription subject but registers neither the black cartridges 30K nor color cartridges 30C as the subscription subject. In this case, the technology applied to the black cartridge 30K in the embodiment is used for the drum cartridges 20. Further, a subscription plan may be configured to register only some of the four drum cartridges 20 as the subscription subjects and not register the remaining drum cartridges 20 as the subscription subjects. For example, the subscription plan may be configured to register as the subscription subject the drum cartridge 20 to which the black cartridge 30K is attached (the black drum cartridge) and does not register as the subscription subject the drum cartridges 20 to which the color cartridges 30C are attached (the color drum cartridges). In this case, the technology applied to the black cartridge 30K in the embodiment may be used solely for this drum cartridge 20 (the black drum cartridge).

While the description has been made in detail with reference to the present disclosure, the description is merely an example in all aspects and the present disclosure is not limited thereto. It would be apparent to those skilled in the art that many modifications and variations may be made therein without departing from the scope of the disclosure. Further, parts and components appearing in the embodiment and modifications may be suitably combined together and omitted as long as any conflicting structure is avoided.

What is claimed is:

1. An image forming apparatus comprising:

a main casing;

a plurality of cartridges capable of being attached to the main casing, the plurality of cartridges including:

a specific-color cartridge including:

a specific-color casing configured to accommodate printing material of a specific color; and a specific-color memory configured to store type information indicating one of a normal type and a subscription type; and a non-specific-color cartridge including:

a non-specific-color casing configured to accommodate printing material of a non-specific color other than the specific color; and a non-specific-color memory configured to store type information indicating one of a normal type and a subscription type;

a printing mechanism configured to execute a print process using the plurality of cartridges; and a controller configured to perform processes in accordance with an operation mode for the image forming apparatus, the operation mode being settable to one of a first subscription mode and a second subscription mode, the first subscription mode corresponding to a first subscription in which the specific-color cartridge is a subscription subject and the non-specific-color cartridge is not the subscription subject, the second subscription mode corresponding to a second subscription in which both the specific-color cartridge and the non-specific-color cartridge are the subscription subject, wherein the controller is configured to perform restricting usage of the non-specific-color cartridge in a case where the first subscription mode is set as the operation mode and the type information of the non-specific-color cartridge indicates the subscription type, compared to a case where the second subscription mode is set as the operation mode and the type information of the non-specific-color cartridge indicates the subscription type.

2. The image forming apparatus according to claim 1, wherein the controller is configured to perform:

a first identification process to identify a type of the specific-color cartridge based on the type information stored in the specific-color memory; and a second identification process to identify a type of the non-specific-color cartridge based on the type information stored in the non-specific-color memory.

3. The image forming apparatus according to claim 2, wherein the operation mode is settable to a first pre-subscription mode from which the controller can shift to the first subscription mode, wherein the controller shifts the operation mode to the first pre-subscription mode based on subscription information indicating the first subscription, wherein in a case where the first pre-subscription mode is set as the operation mode, and the specific-color cartridge is identified as the subscription type in the first identification process and the non-specific-color cartridge is identified as the normal type in the second identification process, the controller shifts the operation mode to the first subscription mode from the first pre-subscription mode.

4. The image forming apparatus according to claim 3, further comprising a display configured to display display-information, wherein the controller is further configured to display, on the display, display-information indicating that the specific-color cartridge having the type information indicating the subscription type can be used in a case where the first pre-subscription mode is set as the operation mode and the specific-color cartridge is identified as the normal type in the first identification process.

5. The image forming apparatus according to claim 4, wherein the controller is configured to further perform:

a print request reception process to receive a print request;

displaying, on the display, display-information indicating that the specific-color cartridge having the type information indicating the subscription type can be used in a case where the first pre-subscription mode is set as the operation mode, the print request is received in the print request reception process, and the specific-color cartridge is identified as the normal type in the first identification process.

6. The image forming apparatus according to claim 4, wherein the controller is further configured to display, on the display, display-information indicating that the specific-color cartridge is currently shipped in a case where the first pre-subscription mode is set as the operation mode and the specific-color cartridge is identified as the normal type in the first identification process.

7. The image forming apparatus according to claim 4, wherein the controller is configured to further perform displaying, on the display, display-information prompting change of a subscription plan based on a usage amount of the specific-color cartridge and a usage amount of the non-specific color cartridge.

8. The image forming apparatus according to claim 4, further comprising a life memory configured to store life information indicating remaining life of the specific-color cartridge and remaining life of the non-specific color cartridge, wherein the controller is configured to further perform displaying, on the display, display-information prompting replacement of the specific-color cartridge of the normal type with a specific-color cartridge of the subscription type based on the life information in a case where the first pre-subscription mode is set as the operation mode and the specific-color cartridge is identified as the normal type in the first identification process.

9. The image forming apparatus according to claim 8, wherein the controller is configured to further perform displaying, on the display, display-information prompting replacement of the non-specific-color cartridge of the normal type with a non-specific-color cartridge of the normal type based on the life information in a case where the first pre-subscription mode is set as the operation mode and the non-specific-color cartridge is identified as the normal type in the second identification process.

10. The image forming apparatus according to claim 3, further comprising a communication interface configured to communicate with a communication apparatus, wherein the controller is configured to further perform a shift notification process to notify shift of the operation mode in a case where the operation mode shifts to one of the first subscription mode and the second subscription mode.

11. The image forming apparatus according to claim 10, wherein the controller is configured to further perform a usage information transmission process to transmit to the communication apparatus usage information related to a usage amount of the specific-color cartridge of the subscription type and usage information related to a usage amount of the non-specific-color cartridge of the subscription type.

12. The image forming apparatus according to claim 11, wherein the operation mode is settable to a second pre-subscription mode from which the controller can shift the operation mode to the second subscription mode, wherein in a case where the second pre-subscription mode is set as the operation mode, and the specific-color cartridge is identified as the subscription type in the first identification process and the non-specific-color cartridge is identified as the normal type in the second identification process, the controller transmits the usage information based on the usage amount of the specific color cartridge in the usage information transmission process, wherein in a case where the second pre-subscription mode is set as the operation mode, and the specific-color cartridge is identified as the normal type in the first identification process and the non-specific-color cartridge is identified as the subscription type in the second identification process, the controller transmits the usage information based on the usage amount of the non-specific color cartridge in the usage information transmission process.

13. The image forming apparatus according to claim 10, further comprising a life memory configured to store life information indicating remaining life of the specific-color cartridge and remaining life of the non-specific color cartridge, wherein the controller is configured to further perform transmitting to the communication apparatus order information for ordering a new specific-color cartridge of the subscription type based on the life information in a case where the first subscription mode is set as the operation mode and the specific-color cartridge is identified as the subscription type in the first identification process, wherein the controller does not transmit to the communication apparatus order information for ordering a new non-specific-color cartridge based on the life information in the first subscription mode.

14. The image forming apparatus according to claim 2, wherein the operation mode is settable to a second pre-subscription mode from which the controller can shift the operation mode to the second subscription mode, wherein the controller shifts the operation mode to the second pre-subscription mode based on subscription information indicating the second subscription, wherein the controller shifts the operation mode to the second subscription mode from the second pre-subscription mode in a case where the second pre-subscription mode is set as the operation mode, and the specific-color cartridge is identified as the subscription type in the first identification process and the non-specific-color cartridge is identified as the subscription type in the second identification process.

15. The image forming apparatus according to claim 1, wherein the operation mode is settable to a normal mode corresponding to an uncontracted state in which the first subscription or the second subscription is not joined, wherein the controller is configured to further perform:

restricting usage of the specific-color cartridge in a case where the normal mode is set as the operation mode and the type information of the specific-color cartridge indicates the subscription type; and restricting usage of the non-specific-color cartridge in a case where the normal mode is set as the operation mode and the type information of the non-specific-color cartridge indicates the subscription type.

16. The image forming apparatus according to claim 1, wherein the printing mechanism includes:

a drum cartridge capable of being attached to the main casing and including:

a photosensitive drum; and a drum memory configured to store drum type information indicating one of the normal type and the subscription type, wherein the operation mode is settable to a third subscription mode, the third subscription mode corresponding to a third subscription in which both the specific-color cartridge and the drum cartridge is the subscription subjects, wherein in a case where the first subscription mode is set as the operation mode and the drum type information of the drum cartridge is the subscription type, the controller restricts usage of the drum cartridge compared to a case where the third subscription mode is set as the operation mode and the type information of the drum cartridge is the subscription type.

17. The image forming apparatus according to claim 1, wherein the specific color is black and the non-specific color is color other than the black, wherein the specific-color casing is configured to accommodate the printing material of black and the non-specific-color casing is configured to accommodate the printing material of the color other than the black.

18. A method for an image forming apparatus, comprising:

a print process to execute printing using a plurality of cartridges capable of being attached to the image forming apparatus, the plurality of cartridges including a specific-color cartridge and a non-specific-color cartridge, the specific-color cartridge being configured to accommodate printing material of a specific color, the non-specific-color cartridge being configured to accommodate printing material of a non-specific color other than the specific color;

an identification process to identify whether a type of the non-specific-cartridge is a normal type or a subscription type;

a shifting process to shift an operation mode to one of a first subscription mode and a second subscription mode, the first subscription mode corresponding to a first subscription in which the specific-color cartridge is a subscription subject and the non-specific-color cartridge is not the subscription subject, the second subscription mode corresponding to a second subscription in which both the specific-color cartridge and the non-specific-color cartridge are the subscription subject; and a restricting process to restrict usage of the non-specific-color cartridge in a case where the first subscription mode is set as the operation mode and the type of the non-specific-color cartridge is the subscription type, compared to a case where the second subscription mode is set as the operation mode and the type of the non-specific-color cartridge is the subscription type.

19. The method according to claim 18, wherein the specific color is black and the non-specific color is color other than the black, wherein the specific-color cartridge is configured to accommodate the printing material of black and the non-specific-color cartridge is configured to accommodate the printing material of the color other than the black.

* * * * *